US007477271B2

(12) United States Patent
Maki

(10) Patent No.: US 7,477,271 B2
(45) Date of Patent: Jan. 13, 2009

(54) DATA DRIVER, DISPLAY DEVICE, AND METHOD FOR CONTROLLING DATA DRIVER

(75) Inventor: Katsuhiko Maki, Nagano (JP)

(73) Assignee: Seiko Epson Corporation (JP)

( * ) Notice: Subject to any disclaimer, the term of this patent is extended or adjusted under 35 U.S.C. 154(b) by 727 days.

(21) Appl. No.: 11/071,776

(22) Filed: Mar. 3, 2005

(65) Prior Publication Data

US 2005/0195145 A1 Sep. 8, 2005

(30) Foreign Application Priority Data

Mar. 8, 2004 (JP) ..... 2004-064089

(51) Int. Cl.
*G09G 3/36* (2006.01)
*G09G 5/10* (2006.01)

(52) U.S. Cl. ..... 345/690; 345/100

(58) Field of Classification Search ..... 345/98–100, 345/87, 204, 690, 88, 89, 211
See application file for complete search history.

(56) References Cited

U.S. PATENT DOCUMENTS

| | | | | |
|---|---|---|---|---|
| 6,232,941 | B1 | 5/2001 | Ode et al. | |
| 6,518,946 | B2 | 2/2003 | Ode et al. | |
| 6,836,232 | B2 | 12/2004 | Bu | |
| 7,006,071 | B2 | 2/2006 | Bu | |
| 7,102,608 | B2 | 9/2006 | Bu | |
| 7,106,321 | B2 | 9/2006 | Morita | |
| 7,136,039 | B2 | 11/2006 | Bu et al. | |
| 2003/0151577 | A1 * | 8/2003 | Morita | 345/89 |
| 2004/0217981 | A1 | 11/2004 | Bu | |
| 2005/0179634 | A1 | 8/2005 | Bu | |

FOREIGN PATENT DOCUMENTS

| | | |
|---|---|---|
| JP | 06-118905 | 4/1994 |
| JP | 09-252240 | 9/1997 |
| JP | 11-109928 | 4/1999 |
| JP | 2001-188615 | 7/2001 |
| JP | 2003-233357 | 8/2003 |
| JP | 2004-029752 | 1/2004 |

* cited by examiner

*Primary Examiner*—Amr Awad
*Assistant Examiner*—Stephen G Sherman
(74) *Attorney, Agent, or Firm*—Harness, Dickey & Pierce, P.L.C.

(57) ABSTRACT

A data driver is provided comprising: a gamma correction resistor for outputting a gray scale voltage, a gray scale voltage supply switch, first and second operational amplifiers for driving a first and second data lines, inputs of these first and second operational amplifiers being electrically coupled with the gray scale voltage signal line, and first and second bypass switches for bypassing each operational amplifier. In a first period of a drive period, the first and second data lines are driven by the first and second operational amplifiers based on the gray scale voltage of a gray scale voltage signal. In a second period of the drive period, the gray scale voltage supply switch is set to a cut-off state, whereby the first data line is electrically coupled with the second data line via the gray scale voltage signal line, the first bypass switch, and the second bypass switch.

14 Claims, 17 Drawing Sheets

DATA DRIVER, DISPLAY DEVICE, AND METHOD FOR CONTROLLING DATA DRIVER

RELATED APPLICATIONS

This application claims priority to Japanese Patent Application No. 2004-064089 filed Mar. 8, 2004 which is hereby expressly incorporated by reference herein in its entirety.

BACKGROUND

1. Field of the Invention

The present invention relates to a data driver and a display device and a method for controlling the data driver.

2. Related Art

Conventionally, as a liquid-crystal panel (an electro-optical device) used for an electronic apparatus such as a mobile phone, it is known to utilize a passive matrix liquid-crystal panel and an active matrix liquid-crystal panel which employs a switching element such as a thin film transistor (abridged as TFT).

Compared to the active matrix method, the passive matrix method has an advantage, in that power consumption can be easily lowered, while it has a disadvantage in that colorization and image display are difficult. In contrast, the active matrix method has an advantage in that it is suited for colorization and image display, while it has a disadvantage in that it is difficult to lower the power consumption.

Then, recently, in order to provide high-quality images for the mobile telephones and mobile electronic apparatuses, demands for colorization and image display are becoming stronger. Therefore, the active matrix liquid-crystal panel is now coming into more use than the passive matrix liquid-crystal panel.

Now, with the active matrix liquid-crystal panel, it is preferable that it be provided with an operational amplifier which operates as an output buffer inside a data driver for driving data lines of the crystal panel. The operational amplifier has a high driving capacity and can stably supply voltage to the data lines.

The recent demands for high-quality display images have helped progress in multi-level gray scale and reduction of voltage to be applied to liquid crystal. However, variations in voltages applied to liquid crystal have a large influence on the display quality.

In addition, there are also variations in threshold voltages of transistors composing the operational amplifier which is provided at each data line inside a data driver. Therefore, differences occur in output voltages among the operational amplifiers within the same IC, and, thus, there are cases in which the variations in the voltages applied to liquid crystal influence on the display quality.

In view of the above technical issues, the present invention aims to provide a data driver having a simple configuration which prevents degradation of the display quality created by the variation in output voltages at each data line, a display device, and a method for controlling the data driver.

SUMMARY

In order to solve the above problem, the present invention relates to: a gamma correction resistor for dividing a voltage with resistance between a first power source voltage and a second power source voltage and outputting the divided voltage to a resistance division node as a gray scale voltage; a gray scale voltage signal line to which the gray scale voltage is supplied; a gray scale voltage supply switch provided between the resistance division node and the gray scale voltage signal line; a first operational amplifier and a second operational amplifier for driving a first data line and a second data line out of the plurality of data lines, inputs of the first and second operational amplifiers being electrically coupled with the gray scale voltage signal line; and a first bypass switch and a second bypass switch provided between the input and an output of the first and second operational amplifiers by bypassing each of the first and second operational amplifiers; wherein, the gray scale voltage supply switch is set to a conductive state, and the first and second operational amplifiers are set to a cut-off state, so as to drive the first and second data lines by the first and second operational amplifiers based on the gray scale voltage during a first period of a drive period; and wherein, the gray scale voltage supply switch is set to a cut-off state, the first and second bypass switches are set to a conductive state, and the outputs of the first and second operational amplifiers are set to a high-impedance state, so as to electrically couple the first data line and the second data line via the gray scale voltage signal line, the first bypass switch, and the second bypass switch during a second period succeeding the first period of the drive period.

Note that the second period is within the drive period and needs only be a period following the first period.

In the present invention, in the first period, the gray scale voltage output to the resistance division node of the gamma correction resistor is supplied to the gray scale voltage signal line. Then, the gray scale voltage signal line is electrically connected with the inputs of the first and second operational amplifiers. Since, in the first period, the first and second bypass switches are in a cut-off state, the first and second operational amplifiers drive the first and second data lines based on the gray scale voltage of the gray scale voltage signal line.

Then, in the second period, the gray scale voltage signal line is electrically cut off from the resistance division node of the gamma correction resistor. Then, because the first and second bypass switches are set to a conductive state at the same time when the outputs of the first and second operational amplifiers are set to a high-impedance state, the first and second data lines that were driven by the first and second operational amplifiers in the first period are electrically connected via the first bypass switch, the gray scale voltage signal line, and the second bypass switch.

Consequently, even when the output voltages of the first and second operational amplifiers have errors, the first and second data lines can have an equivalent voltage without having a complex configuration or conducting a complex control. Despite the fact that the first and second graduation data corresponding to the first and second operational amplifiers are identical, the degradation of the display quality can be prevented even when differences occur in the output voltages caused, for example, by variations in threshold voltages of the transistors composing each operational amplifier.

Further, the data driver of the present invention includes: a gamma correction resistance switch of which, one end receives the first and second power source voltages, and the other end is coupled to the gamma correction resistor; wherein, the gamma correction resistance switch can be set to a conductive state during the first period, and, the gamma correction resistance switch can be set to a cut-off state during the second period.

According to the present invention, since the current flowing in the gamma correction resistor can be reduced in the second period, an unnecessary current consumption can be reduced.

Moreover, with the data driver of the present invention, during the second period, an operation current of the first and second operational amplifiers can be either stopped or limited.

According to the present invention, in the second period, an excess operation current of the first and second operational amplifiers can be reduced.

In addition, the data driver of the present invention includes: a plurality of gray scale voltage supply switches, each gray scale voltage supply switch being provided between each of a plurality of resistance division nodes of the gamma correction resistor and each of a plurality of gray scale voltage signal lines; a first decoder for electrically coupling any one of the plurality of gray scale voltage signal lines with the input of the first operational amplifier based on first gray scale data corresponding to the first data line; and a second decoder for electrically coupling any one of the plurality of gray scale voltage signal lines with the input of the second operational amplifier based on second gray scale data corresponding to the second data line; wherein each of the first and second decoders can electrically couple the inputs of the first and second operational amplifiers with the gray scale voltage signal line and any one of a plurality of gray scale voltages selected corresponding to least significant (b+c) bit data of the gray scale data based on most significant a bit data of (a+b+c) (a, b, and c are positive integers) bit gray scale data is supplied to the gray scale voltage signal lines; and wherein, when the first and second gray scale data are identical, the first and second data lines can be electrically coupled via the gray scale voltage signal line, the first bypass switch, and the second bypass switch.

According to the present invention, compared to when the decoder is composed of a commonly known ROM, the number of transistors can be decreased wherein a path, to which the gray scale voltages selected by the decoder are supplied, goes through these transistors, and the drop in the selected gray scale voltage can be lessened. Therefore, the degradation of display quality caused by the drop in the selected gray scale voltage can be prevented.

Further, with the data driver of the present invention, each of the first and second decoders may include: a first selector of a first conductivity type having a plurality of MOS transistors of the first conductivity type whose drains are electrically coupled with one another, a gate signal corresponding to the a bit data of the gray scale data being applied to a gate of each MOS transistor of the first conductivity type; and a first selector of a second conductivity type having a plurality of MOS transistors of the second conductivity type whose drains are electrically coupled with one another, a gate signal corresponding to the a bit data of gray scale data being applied to a gate of each MOS transistor of the second conductivity type; wherein a node for coupling drains of the MOS transistors of the first conductivity type composing the first selector of the first conductivity type may be electrically coupled with a node for coupling drains of the MOS transistors of the second conductivity type composing the second selector of the second conductivity type; and wherein any one of the plurality of gray scale voltages selected corresponding to the (b+c) bit data of the gray scale data may be supplied to a source of each of the plurality of MOS transistors composing each first selector.

Further, the data driver of the present invention includes: $2^a$ second selectors of the first conductivity type and $2^a$ second selectors of the second conductivity type; wherein the second selector of the first conductivity type contains a plurality of MOS transistors of the first conductivity type whose drains are electrically coupled with one another, a gate signal corresponding to the b bit data of the gray scale data being applied to a gate of each MOS transistor of the first conductivity type, and a node, at which the drains of the MOS transistors of the first conductivity type are electrically coupled with one another, may be electrically coupled with any one of sources of the MOS transistors of the first conductivity type composing the first selector of the first conductivity type; and wherein the second selector of the second conductivity type contains a plurality of MOS transistors of the second conductivity type whose drains are electrically coupled with one another, a gate signal corresponding to the b bit data of gray scale data being applied to a gate of each MOS transistor of the second conductivity type, and a node, at which the drains of the MOS transistors of the second conductivity type may be electrically coupled with one another, is electrically coupled with any one of sources of the MOS transistors of the second conductivity type composing the first selector of the second conductivity type.

According to the present invention, per each conductive type, a selector composed of a transmission gate (a path gate) is provided so that the output of the conductive first selector on one side is compensated with the output of the conductive second selector on the other side. Consequently, the dropped threshold voltage of the gray scale voltage at each transmission gate can be compensated, and the number of transistors, through which the supply path of the selected gray scale voltages passes, can be decreased.

Also, with the data driver of the present invention, each MOS transistor composing the $2^a$ second selectors of the first conductivity type is arranged in a direction intersecting with a channel width direction of each MOS transistor composing the first selector of the first conductivity type; wherein the channel width directions of the MOS transistors composing the first and second selectors of the first conductivity type are parallel with each other; and wherein an on-resistance of each MOS transistor composing the first selector of the first conductivity type can be smaller than an on-resistance of each MOS transistor composing the second selector of the first conductivity type.

In the present invention, the path for the selected gray scale voltages always passes through the MOS transistor composing the first selector. Therefore, by lowering the on-resistance of the MOS transistor composing the first selector, the voltage drop can be effectively prevented.

Further, with the data driver of the present invention, a channel width of each MOS transistor composing the first selector of the first conductivity type may be larger than a channel width of each MOS transistor composing the second selector of the first conductivity type.

According to the present invention, since the number of the first selectors is smaller than the number of the second selectors, the channel width of the MOS transistors composing the first selector can be made larger than the channel width of the MOS transistors composing the second selector without unnecessarily broadening the layout region. Therefore, the on-resistance of the MOS transistors composing the first selector, through which the gray scale voltage selection path always passes, can be lowered, and, thus, the voltage drop can be effectively prevented.

Further, the present invention relates to a display device including: a plurality of scan lines, a plurality of data lines, a plurality of switching elements, each of which being electrically coupled with each scan line and data line, a scan line driver for driving the plurality of scan lines, and the data driver according to any of the descriptions above.

The present invention can provide the display device in which the degradation of the display quality caused by the output voltage variation at each data line is prevented.

Further, the present invention relates to a method for controlling the data driver for driving a plurality of data lines based on gray scale data, the data driver including: a gamma correction resistor for dividing a voltage with resistance between a first power source voltage and a second power source voltage and outputting the divided voltage to a resistance division node as a gray scale voltage; a gray scale voltage signal line to which the gray scale voltage is supplied; a gray scale voltage supply switch provided between the resistance division node and the gray scale voltage signal line; a first operational amplifier and a second operational amplifier for driving a first data line and a second data line out of the plurality of data lines of an electro-optical device, inputs of the first and second operational amplifiers being electrically coupled with the gray scale voltage signal line; and a first bypass switch and a second bypass switch provided between the input and an output of the first and second operational amplifiers by bypassing each of the first and second operational amplifiers; the method comprising the steps of: setting a gray scale voltage supply switch to a conductive state and the first and second bypass switches to a cut-off state, so as to drive the first and second data lines based on the gray scale voltage by the first and second operational amplifiers during a first period of a drive period; and setting the gray scale voltage supply switch to a cut-off state, the first and second bypass switches to a conductive state, and the outputs of the first and second operational amplifiers to a high-impedance state, so as to electrically couple the first data line with the second data line via the gray scale voltage signal line, the first bypass switch, and the second bypass switch during a second period succeeding the first period of the drive period.

In the method for controlling the data driver of the present invention, during the second period, the connection between the gamma correction resistor and the first or second power source voltage can be electrically cut.

In the method for controlling the data driver of the present invention, during the second period, the operation current of the first and second operational amplifiers can be stopped or limited.

DETAILED DESCRIPTION

Now, detailed descriptions of embodiments of the present invention will follow with reference to the accompanying drawings. Note that the following descriptions of the embodiments do not improperly limit the content of the present invention described in the claims. Further, not all the configurations described below are necessarily the essential elements of the present invention.

1. Display Device

Figure 1:
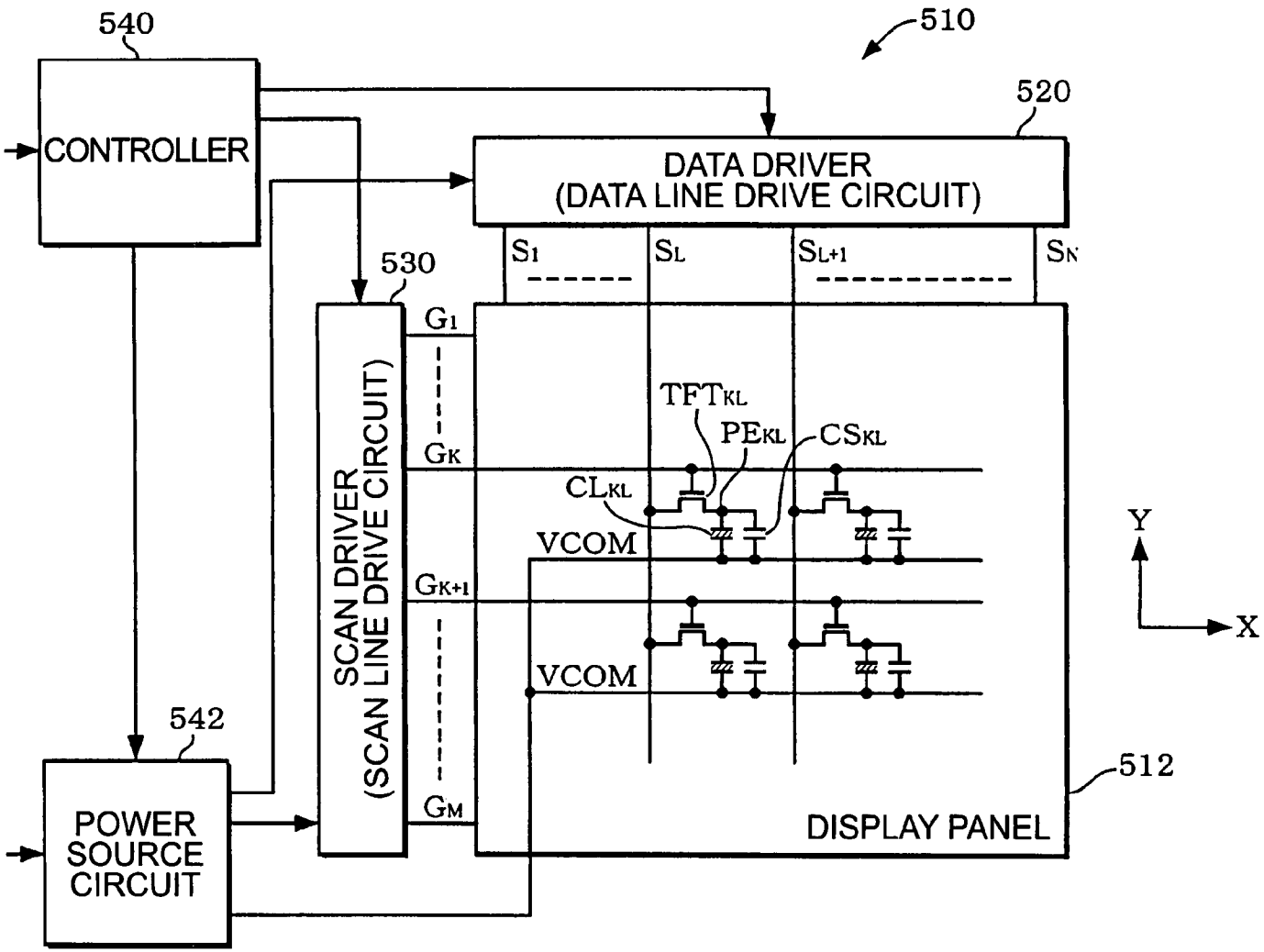
FIG. 1 is an example of a block diagram of a display device of the present embodiment.

FIG. 1 shows an example of a block diagram of the display device of the present embodiment.

This display device 510 is a liquid-crystal device. The display device 510 includes a display panel 512 (to define narrowly, a liquid crystal display or an LCD), a data driver (a data line-drive circuit) 520, a scan driver (a scan line drive circuit) 530, a controller 540, and a power source circuit 542. Further, it is not necessary to include all these circuit blocks in the display device 510, and some part of the circuit blocks may be omitted.

Here, the display panel 512 (to define broadly, the electro-optical device) includes a plurality of scan lines (narrowly, gate lines), a plurality of data lines (narrowly, source lines), and pixel electrodes specified by the scan lines and the data lines. In this case, by coupling thin film transistors (TFTs; broadly, switching elements) with the data lines and by coupling the pixel electrodes to the TFTs, an active matrix liquid-crystal device can be composed.

More specifically, the display panel 512 is formed on an active matrix substrate (e.g., a glass substrate). On the active matrix substrate, a plurality of scan lines $G_1$ to $G_M$ (M is a natural number of 2 or more) are arranged in a Y direction as in FIG. 1, each extending in an X direction, and a plurality of data lines $S_1$ to $S_N$ (N is a natural number of 2 or more) are arranged in an X direction, each extending in a Y direction. Further, the thin film transistor $TFT_{KL}$ (broadly, the switching element) is provided in a position corresponding to an intersection of a scan line $G_K$ ($1 \leqq K \leqq M$; K is a natural number) and a data line $S_L$ ($1 \leqq L \leqq N$; L is a natural number).

A gate electrode of the $TFT_{KL}$ is coupled with the scan line $G_K$; a source electrode of the $TFT_{KL}$ is coupled with the data line $S_L$; and a drain electrode of the $TFT_{KL}$ is coupled with a pixel electrode $PE_{KL}$. Between this pixel electrode $PE_{KL}$ and an opposing electrode (a common electrode) opposite the pixel electrode $PE_{KL}$, with a liquid-crystal element (to define broadly, an electro-optical material) interposed therebetween, a liquid-crystal capacitance $CL_{KL}$ (a liquid-crystal element) and a supplementary capacitance $CS_{KL}$ are formed. Then, liquid crystal is filled between the active matrix substance, on which the $TFT_{KL}$, the pixel electrode $PE_{KL}$, etc. are formed, and the opposing substrate, on which the opposing electrode VCOM is formed. Thus, depending on the voltage applied between the pixel electrode $PE_{KL}$ and the opposing electrode VCOM, permeability of the pixel is subject to change.

Further, a common voltage supplied to the opposing electrode VCOM is generated in the power source circuit 542. In addition, the opposing electrode VCOM does not have to be formed on the whole surface of the opposing substrate but may be formed in a form of a strip so as to correspond to each scan line.

The data driver 520 drives the data lines $S_1$ to $S_N$ of the display panel 512 based on the gray scale data. On the other hand, the scan driver 530 sequentially drives the scan lines $G_1$ to $G_M$ of the display panel 512.

The controller 540 controls the data driver 520, the scan driver 530, and the power source circuit 542 based on content established by a host such as a central processing unit (abridged as CPU) which is not shown in the drawings.

More specifically, for the data driver 520 and the scan driver 530, the controller 540 supplies vertical synchronization signals or horizontal synchronization signals which were generated when setting an operation mode or generated inside the controller 540; while, for the power source circuit 542, the controller controls an inverted timing of the common voltage of the opposing electrode VCOM.

Based on the reference voltage supplied from the outside, the power source circuit 542 generates various voltages needed for driving the display panel 512 and the common voltage of the opposing electrode VCOM.

Further, although FIG. 1 shows a configuration in which the display device 510 contains the controller 540, the controller 540 may be provided outside the display device 510. Alternatively, the display device 510 may contain the host in addition to the controller 540. Further, some of or all of the data driver 520, the scan driver 530, the controller 540, and the power source circuit 542 may be formed on the display panel 512.

1.1 Data Line Drive Circuit

Figure 2:
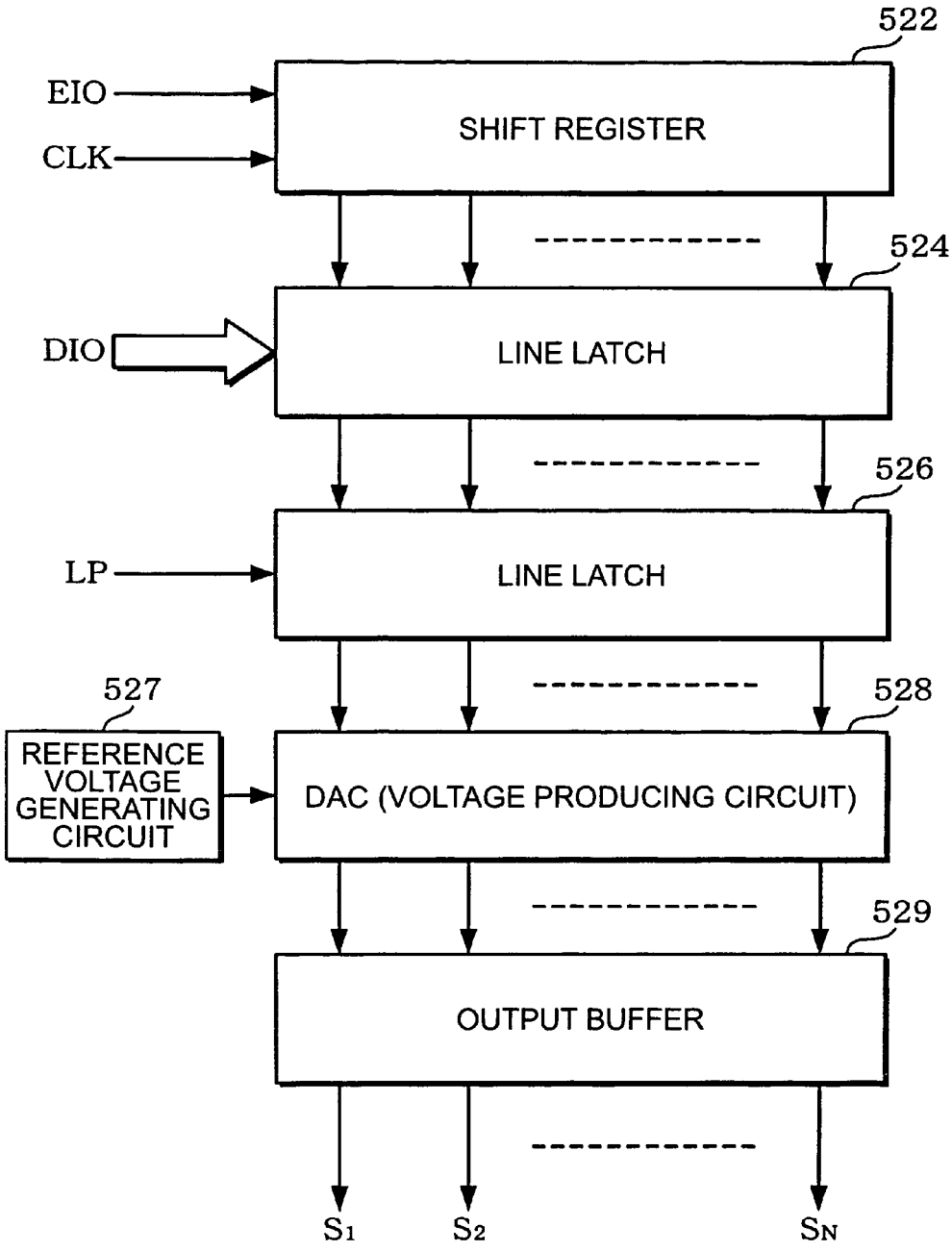
FIG. 2 is a diagram showing a configuration example of a data driver of FIG. 1.

FIG. 2 shows a configuration example of the data driver 520 of FIG. 1.

The data driver 520 includes a shift register 522, line latches 524 and 526, a reference voltage generating circuit 527, a digital-to-analog converter 528 (a DAC or, to define broadly, a voltage producing circuit), and an output buffer 529.

The shift register 522 is provided corresponding to each data line and includes a plurality of sequentially coupled flip-flops. Upon holding an enable input-output signal EIO in synchronization with a clock signal CLK, this shift register 522 shifts the enable input-output signal EIO to the adjacent flip-flop in sequential synchronization with the clock signal CLK.

To the line latch 524, 18 bits (6 bits (the gray scale data)× 3(colors R, G, and B)) per unit, for example, of the gray scale data (the DIO or, to define broadly, the digital data) is input from the controller 540. The line latch 524 latches this gray scale data (DIO) in synchronization with the enable input-output signal EIO which was sequentially shifted by each flip-flop of the shift resister 522.

The line latch 526 latches one horizontal scan unit of the gray scale data, which was latched by the line latch 524, in synchronization with the horizontal synchronization signal LP supplied from the controller 540.

The reference voltage generating circuit 527 generates a plurality of reference voltages (narrowly, gray scale voltages; broadly, generated voltages), each reference voltage corresponding to each gray scale data. The reference voltage generating circuit 527 contains the gamma correction resistor and outputs the divided voltage, which was created by dividing, by resistance, the voltage of both ends of the gamma correction resistor as the gray scale voltage (the generated voltage). Therefore, by changing a resistance division ratio, the gray scale voltage corresponding to the gray scale data can be adjusted, thereby carrying out the so-called gamma correction.

The DAC 528 generates an analog data voltage to be supplied to each data line. More specifically, the DAC 528 selects any one gray scale voltage (a generated voltage) out of the plurality of gray scale voltages (the generated voltages) generated in the reference voltage generating circuit 527 based on the digital gray scale data (the digital data) and then outputs the gray scale voltage as an analog data voltage corresponding to the digital gray scale data (the digital data).

The output buffer 529 buffers the data voltage from the DAC 528 and outputs it to the data line, thereby driving the data line. More specifically, the output buffer 529 contains a voltage-follower-coupled operational amplifier (operational amplifier) provided at each data line, in that each operational amplifier exchanges the impedance of the data voltage from the DAC 528 and outputs the data voltage to each data line.

1.2 Scan Driver

Figure 3:
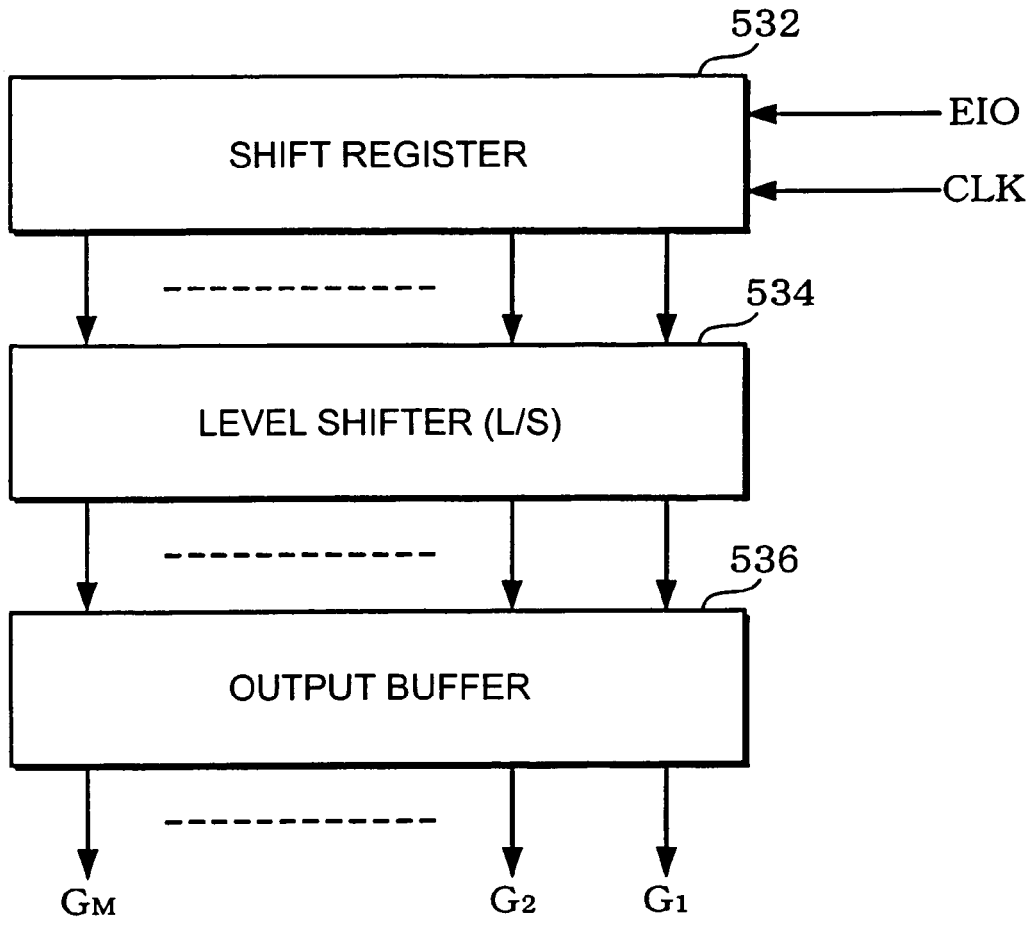
FIG. 3 is a diagram showing a configuration example of a scan driver of FIG. 1.

FIG. 3 shows an example of a configuration of the scan driver 530 of FIG. 1.

The scan driver 530 includes a shift register 532, a level shifter 534, and an output buffer 536.

The shift register 532 is provided corresponding to each scan line and contains a plurality of sequentially coupled flip-flops. Upon holding the enable input-output signal EIO in the flip-flop in synchronization with the clock signal CLK, this shift register 532 shifts the enable input-output signal EIO to the adjacent flip-flop in synchronization with the clock signal CLK. The enable input-output signal EIO input here is the vertical synchronization signal supplied from the controller 540.

The level shifter 534 shifts the level of the voltage from the shift register 532 depending on a liquid-crystal element and a transistor capacity of the TFT of the display panel 510. It is required that the voltage level in this case be as high as 20V to 50V, for example.

The output buffer 536 buffers the scan voltage shifted by the level shifter 534 and outputs it to the scan line, thereby driving the scan line.

2. Detailed Description of Data Driver

With the present embodiment using a simple configuration, the problem of the degradation of the display quality created by the output voltage variation in the operational amplifier (the operational amplifier), which is provided at each data line in the output buffer 529, can be solved.

Figure 4:
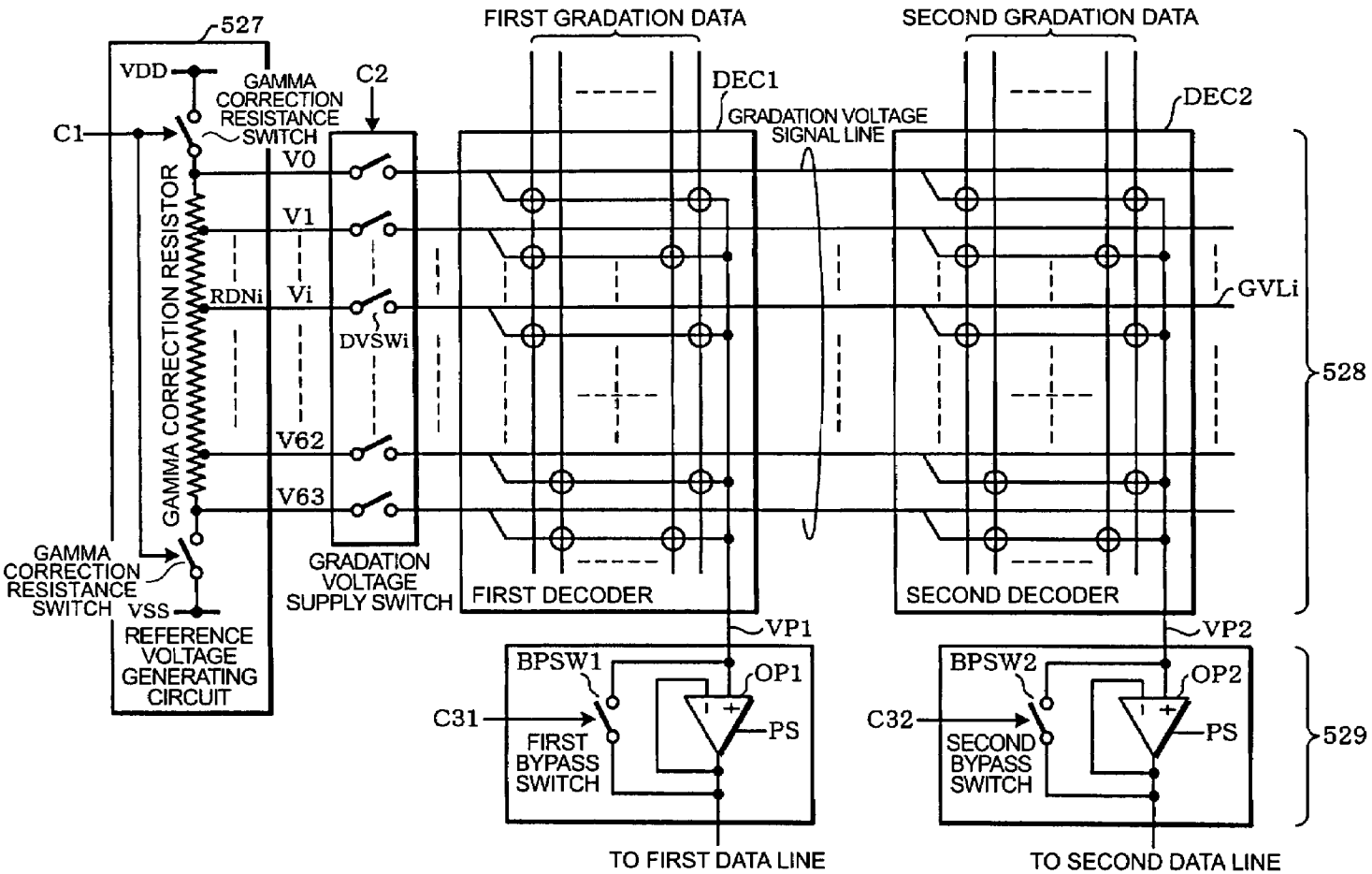
FIG. 4 is a diagram showing a configuration example of a main portion of the data driver of the present embodiment.

FIG. 4 shows a configuration example of a main portion of the data driver of the present embodiment. Note that some of the reference numerals used here are also used in FIG. 2 for the parts that are identical with the data driver 520 in FIG. 2, and, therefore, some descriptions are omitted when suited.

FIG. 4 shows the drive section of two data lines (first and second) out of the data lines $S_1$ to $S_N$ of the display panel 512. Also, assume here that the gray scale data corresponding to each data line is 6 bits, and the gray scale level is 64 ($=2^6$).

The reference voltage generating circuit 527 contains the gamma correction resistor. The gamma correction resistor outputs the divided voltage Vi ($0 \leqq i \leqq 63$; i is an integer) obtained by dividing, by resistance, the voltage between a system power source voltage VDD (a first power voltage) and a system ground power source voltage VSS (a second power voltage) to a resistance division node RDNi as the gray scale voltage Vi.

To a gray scale voltage signal line GVLi, the gray scale voltage Vi is supplied. More specifically, between the resistance division node RDNi and the gray scale voltage signal line GVLi, a gray scale voltage supply switch DVSWi is provided. Then, when the gray scale voltage supply switch DVSWi is in a conductive state, the gray scale voltage Vi is supplied to the gray scale voltage signal line GVLi. Further, when the gray scale voltage supply switch DVSWi is in a cut-off state, the gray scale voltage signal line GVLi is electrically cut off from the resistance division node RDNi.

The output buffer 529 includes a first operational amplifier OP1 provided corresponding to the first data line and a second operational amplifier OP2 provided corresponding to the second data line. The configurations of the first and second operational amplifiers OP1 and OP2 are identical. Further, when the gray scale data corresponding to each of the operational amplifiers is identical, the inputs of the first and second operational amplifiers OP1 and OP2 are electrically coupled with the gray scale voltage signal line GVLi.

Such coupling of the input of the first operational amplifier OP1 is conducted by a first decoder (a voltage generating circuit) DEC1 provided corresponding to the first operational amplifier. The first decoder DEC1 electrically couples one of the plurality of gray scale voltage signal lines with the input of the first operational amplifier OP1 based on the first gray scale data corresponding to the first operational amplifier OP1.

Similarly, the coupling of the input of the second operational amplifier OP2 as mentioned is conducted by a second decoder (a voltage generating circuit) DEC2 provided corresponding to the second operational amplifier. The second decoder DEC2 electrically couples one of the plurality of gray scale voltage signal lines with the input of the second operational amplifier OP2 based on the second gray scale data corresponding to the second operational amplifier OP2.

The first and second decoders DEC1 and DEC2 have an identical configuration. If the gray scale data to be input is identical, then the same gray scale voltage signal lines are coupled to the inputs of the first and second operational amplifiers OP1 and OP2.

Further, with the output buffer 529, a first bypass switch BPSW1 bypasses the first operational amplifier OP1 and is provided between the input and the output of this first operational amplifier OP1. A second bypass switch BPSW2 bypasses the second operational amplifier OP2 and is provided between the input and the output of this second operational amplifier OP2.

In addition, the reference voltage generating circuit 527 can include the gamma correction resistance switch. To one end of this gamma correction resistance switch, the system power source voltage VDD or the system ground power source voltage VSS is supplied, and to the other end, one end of the gamma correction resistor is coupled. The gamma correction resistance switch is set to either a conductive state or a cut-off state by a control signal C1.

Gray scale voltage supply switches DVSW0 to DVSW63 are simultaneously set to a conductive or cut-off state by a control signal C2. Further, the first bypass switch BPSW1 is set to a conductive or cut-off state by a control signal C31. The second bypass switch BPSW2 is set to a conductive or cut-off state by a control signal C32. The control signals C31 and C32 can be considered as identical.

Figure 5:
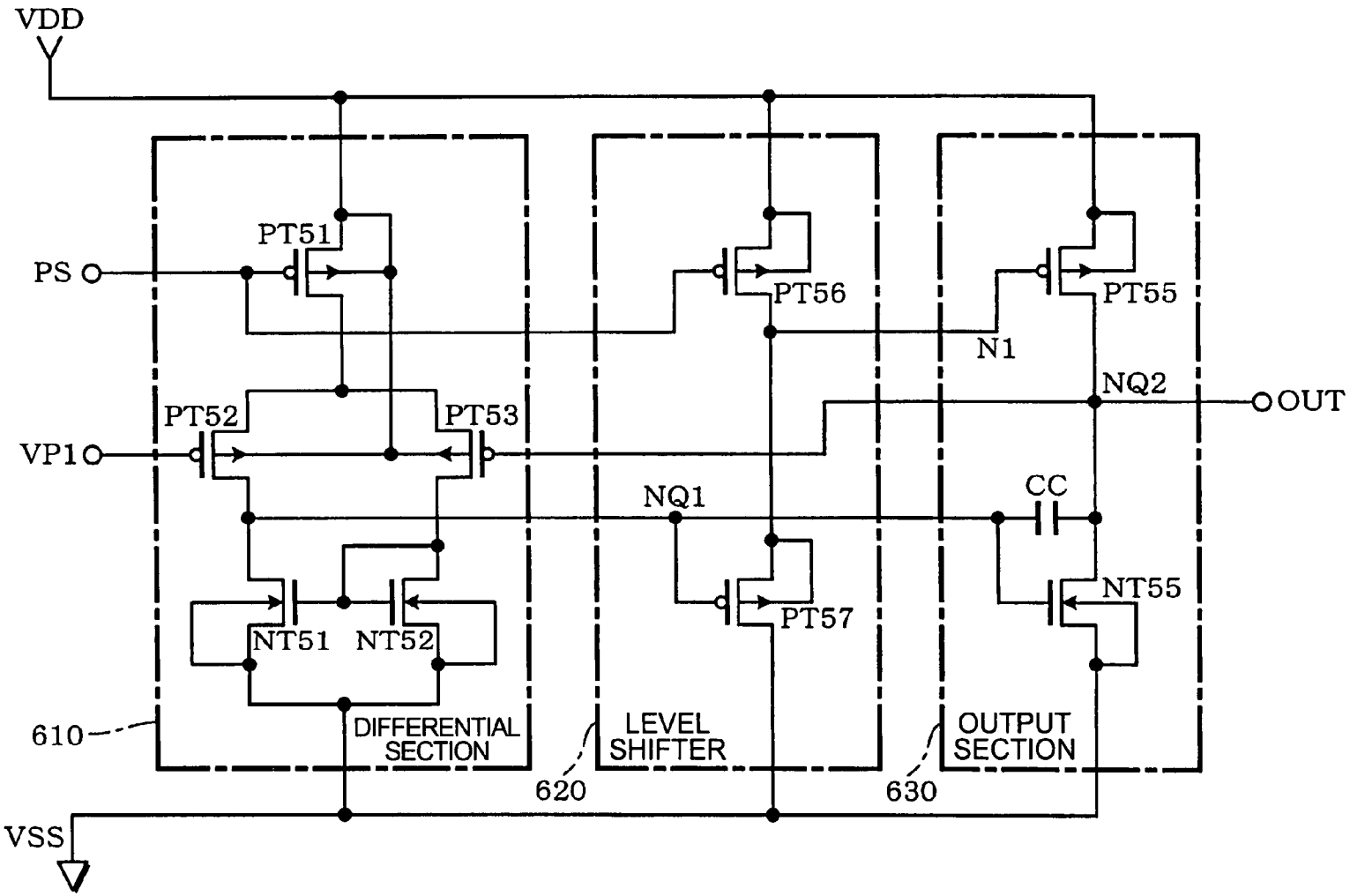
FIG. 5 is a circuit diagram of a configuration example of a first operational amplifier of FIG. 4.

FIG. 5 is a circuit diagram of a configuration example of the first operational amplifier OP1. Although FIG. 5 shows the configuration of the first operational amplifier OP1, the second operational amplifier OP2 has the same configuration.

As the first operational amplifier OP1, a class-AB (push-pull system) operational amplifier circuit having the configuration as shown in FIG. 5, for example, may be used. This class-AB operational amplifier circuit contains a differential section 610, a level shifter 620, and an output section 630.

The differential section 610 amplifies a differential value of differential signals (VP1, OUT). The level shifter 620 shifts the level of the voltage at an output node NQ1 of the differential section 610 and outputs it to a node N1. The level shifter 620 operates on a drain current (an operation current), which flows into a p-transistor PT56, as the current source.

The output section 630 includes a p-drive transistor PT55 to whose gate electrode the node N1 is coupled, an n-drive transistor NT55 to whose gate electrode the node NQ1 is coupled, and a capacitance element CC used for phase compensation.

This operational amplifier circuit is set to a voltage-follower-coupled state when the node NQ2 of the output section 630 is coupled to the gate electrode of the p-transistor PT53 of the differential section 610. Since the voltage-follower-coupled operational amplifier circuit increases the input impedance and decreases the output impedance, stable voltage supply becomes possible.

With the first operational amplifier OP1, the drain currents (the operation currents) of the p-transistors PT51 and PT56 are either limited or stopped by a power save signal PS. Here, the output of the first operational amplifier OP1 is set to a high-impedance state.

Figure 6:
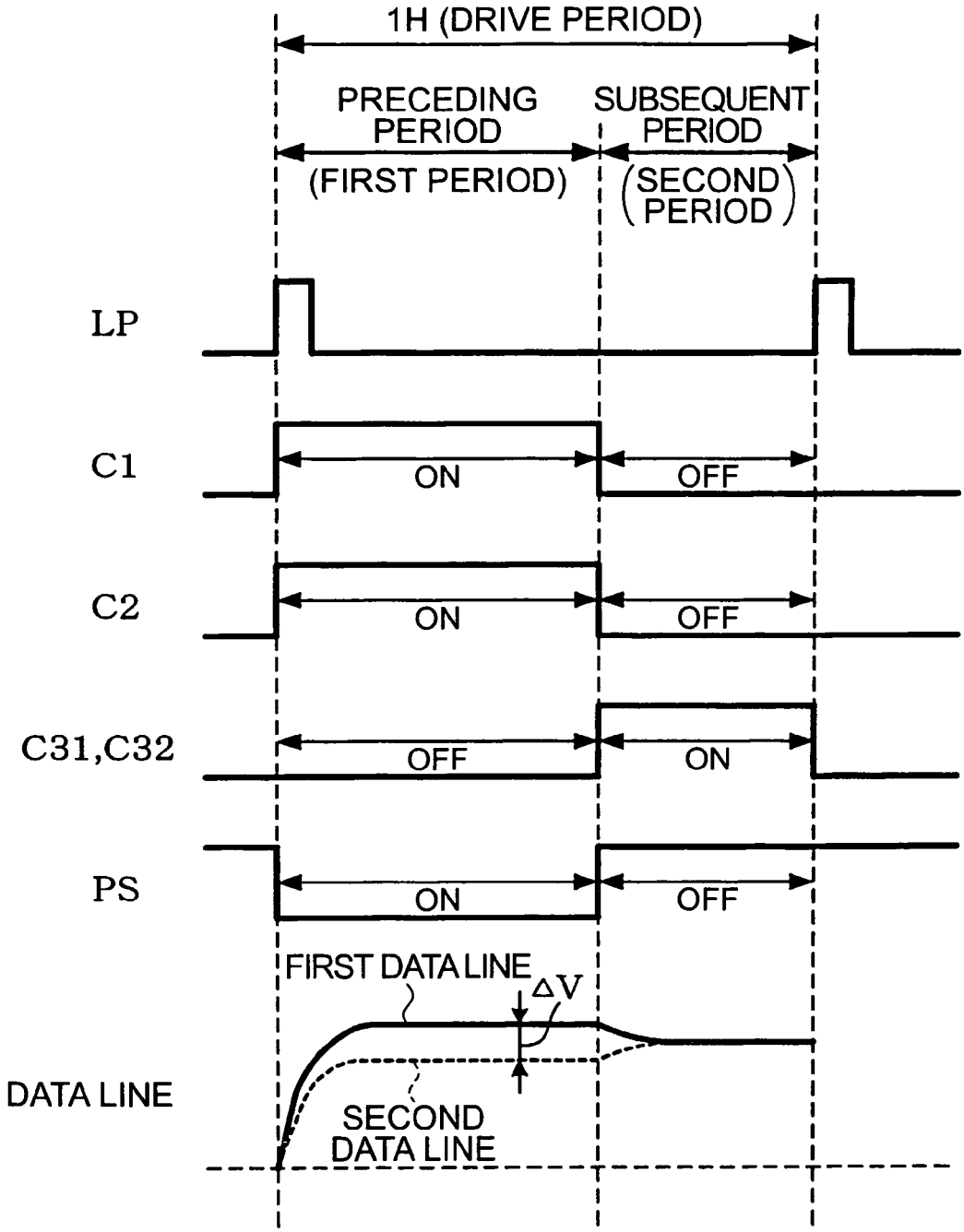
FIG. 6 is a timing diagram illustrating an operation example of the data driver of FIG. 4.

FIG. 6 is a timing diagram illustrating an operation example of the data driver shown in FIG. 4.

Here, the first gray scale data and the second gray scale data are assumed as identical. In a horizontal scan period (to define broadly, a drive period) specified by the horizontal synchronization signal LP, the first and second operational amplifiers OP1 and OP2 drive the first and second data lines based on the gray scale voltage corresponding to the first and second gray scale data.

With the present embodiment, a first period T1 and a second period T2 are established in the horizontal scan period ($1H \geqq T1+T2$). The second period T2 needs only be after the first period T1 and within the horizontal scan period. Further, it is possible to simply divide the horizontal scan period into two periods, naming the preceding period as the period T1 and the subsequent period as the period T2.

In the first period T1, the gamma correction resistance switch is set to a conductive state by the control signal C1. Also, the gray scale voltage supply switches DVSW0 to DVSW63 are set to a conductive state by the control signal C2. Further, the first and second bypass switches BPSW1 and BPSW2 are set to a cut-off state by the control signals C31 and C32. Furthermore, the first and second operational amplifiers OP1 and OP2 are set to an active state by the power save signal PS.

In this first period T1, a same gray scale voltage (Vi) is supplied to the inputs of the first and second operational amplifiers OP1 and OP2. Thus, the first and second data lines are driven by the first and second operational amplifiers based on the gray scale voltage Vi. As a result, presumably, the first data and the second data have the same potential. However, due to a variation or the like in the threshold voltages of the transistors composing the first and second operational amplifiers OP1 and OP2, the output voltage of the first operational amplifier OP1 differs from that of the second operational amplifier OP2, having, for example, a potential difference $\Delta V$ as shown in FIG. 6.

In the following second period T2, the gamma correction resistance switch is set to a cut-off state by the control signal C1. Also, the gray scale voltage supply switches DVSW0 to DVSW63 are set to a cut-off state by the control signal C2.

Further, the first and second bypass switches BPSW1 and BPSW2 are set to a conductive state by the control signals C31 and C32. Furthermore, the first and second operational amplifiers OP1 and OP2 are set to an inactive state by the power save signal, and the outputs of the first and second operational amplifiers are set to a high-impedance state.

Figure 7:
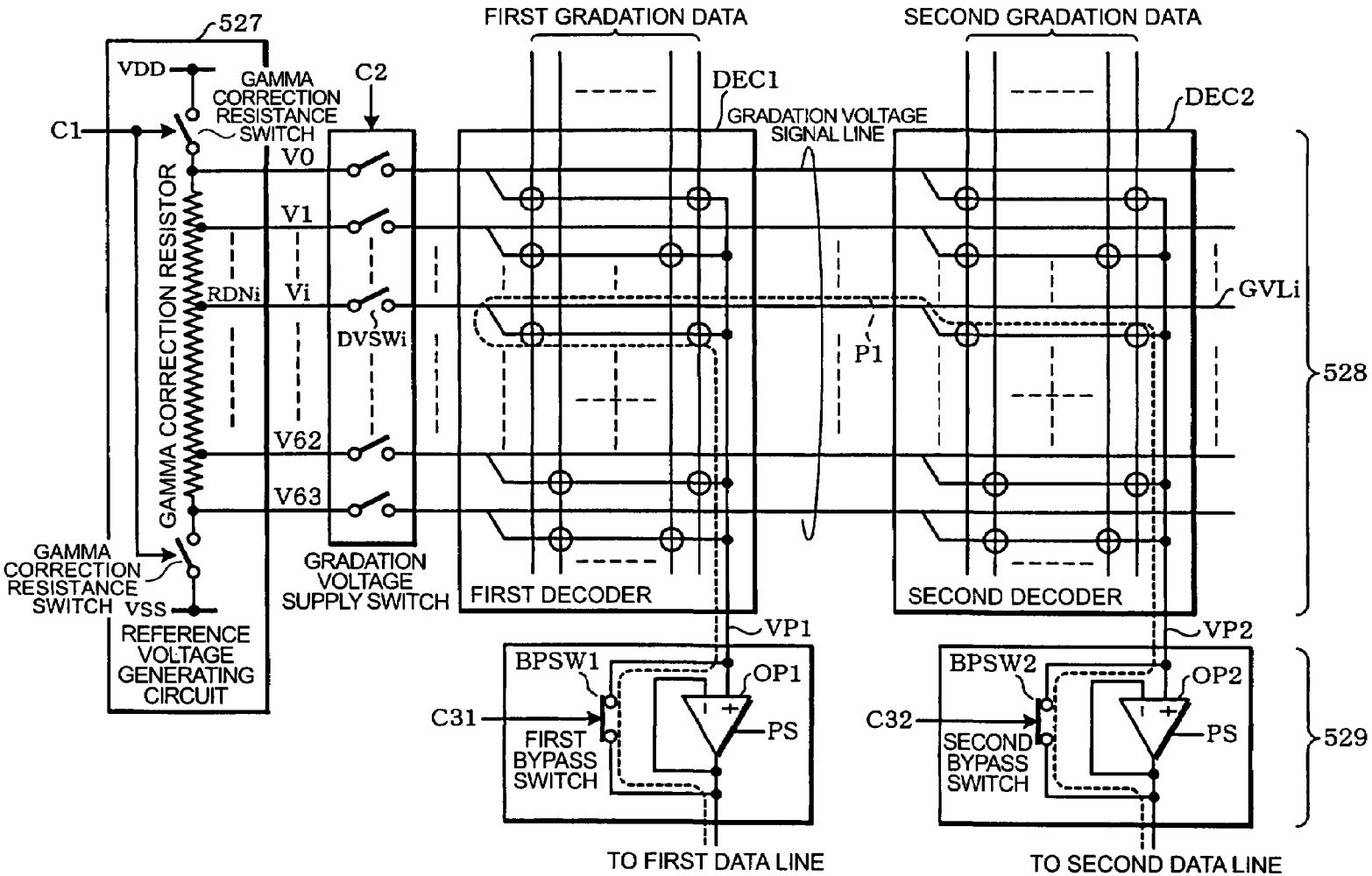
FIG. 7 is a diagram illustrating a path coupling inputs of a first operational amplifier and a second operational amplifier.

In this second period T2, a same gray scale voltage (Vi) is supplied to the inputs of the first and second operational amplifiers OP1 and OP2. Thus, using a path P1 as shown in FIG. 7, the first and second data lines are electrically coupled via the gray scale voltage signal line GVLi, the first bypass switch BPSW1, and the second bypass switch BPSW2. As a result, the first and the second data lines will obtain the same potential as shown in FIG. 6.

Accordingly, even when there is an output voltage variation in the first and second operational amplifiers OP1 and OP2, by having a simple configuration, the first data line and the second data line can have the same potential. Though the voltage may not be the original voltage to be supplied, the degradation of the display quality can be prevented by focusing on each data line and by thus solving the problem of relative unevenness, since the degradation of the display quality is judged from the entire screen.

Further, since the operation currents of the first and second operational amplifiers OP1 and OP2 are made either to be limited or stopped in the second period, the time of operation of the first and second operational amplifiers OP1 and OP2 within the drive period can be shortened, thereby also reducing the current consumption.

In addition, in the second period T2, the gamma correction resistance switch is set to a cut-off state. This can reduce an excessively consumed current that flows in the gamma correction resistor in the second period T2, in which there is an excess gray scale voltage output from the gamma correction resistor. Further, in the second period T2, all the gray scale voltage supply switches are simultaneously set to a cut-off state. Therefore, in this period, electrical coupling of the plurality of gray scale voltage signal lines via the gamma correction resistor can be prevented, and, thereby, the first and second data lines can share the same electricity that was charged when the gray scale voltage Vi was supplied.

Further, with the present embodiment, by limiting or stopping the operation current of the first and second operational amplifiers OP1 and OP2, the outputs of the first and second operational amplifiers OP1 and OP2 are to be set to a high-impedance state. However, it is not limited thereto. That is to say, a switching element may be provided between each of the outputs of the operational amplifiers and each of the data lines, whereby the outputs of the first and second operational amplifiers OP1 and OP1 can be electrically cut off from the first and second data lines in the second period T2, for example.

3. Data Voltage Generating Circuit of the Present Embodiment

With the present embodiment, the first and second data lines are electrically coupled by the path P1 as shown in FIG. 7. Therefore, it is effective to decrease the impedance of the path P1 inside the first and second decoders DEC1 and DEC2. It is because, when the impedance at the path P1 inside the first and second decoders DEC1 and DEC2 is high, there occurs a voltage decrease in the first and second decoders DEC1 and DEC2, and thereby the potential of the first and second data lines in the second period T2 will differ greatly from the original data voltage to be supplied corresponding to the gray scale data.

Figure 8A:
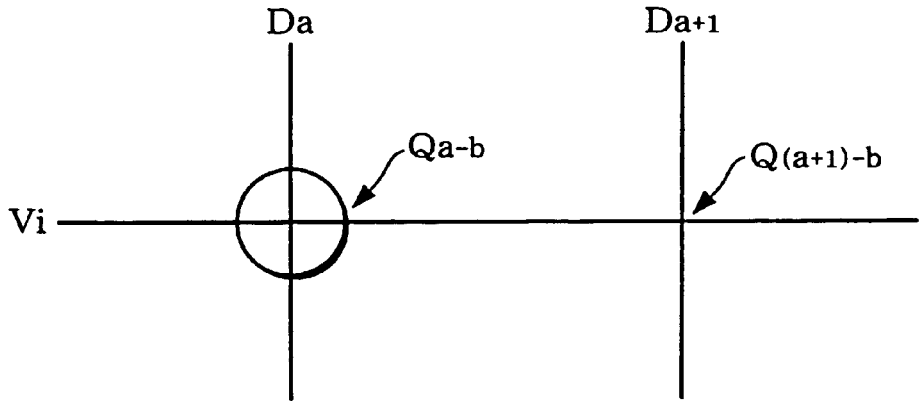
FIG. 8(A) and FIG. 8(B) are diagrams illustrating a configuration example of conventional first and second decoders.
Figure 8B:
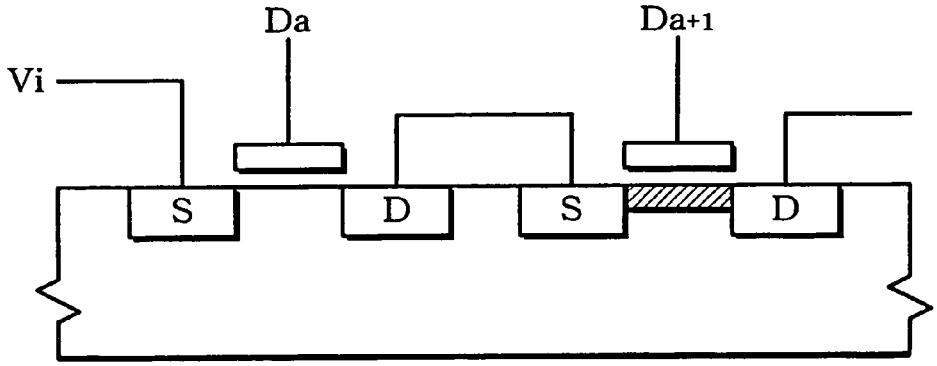

FIG. 8(A) and FIG. 8(B) are diagrams illustrating a configuration example of conventional first and second decoders DEC1 and DEC2. FIG. 8(A) shows an example of the first and second decoders DEC1 and DEC2 configured using a commonly known read-only memory (ROM). In this case, a transistor Qa-b is provided at an intersection of the gray scale voltage signal line GVLi, to which the gray scale voltage Vi is supplied, and a 1-bit data line Da out of the gray scale data.

In an actual case, a transistor Q(a+1)−b is also provided at an intersection of the gray scale voltage signal line GVLi and a 1-bit data line Da+1 out of the gray scale data. Then, as shown in FIG. 8(B), a channel region of the transistor Q(a+1)−b is formed to stay in a constant conductive state by ion implantation to this channel region. Therefore, the transistor Qa-b operates as the commonly-known switching element, and the Q(a+1)−b becomes the switching element that is in a constant on-state.

Consequently, the ROM data can be changed by merely changing masks as commonly known, and, thereby, an effect such as reduction of a layout area can also be exerted.

Now, the configuration of each of the first and second decoders DEC1 and DEC2 shown in FIG. 8(A) and FIG. 8(B) will be considered. If each first and second gray scale data is 6 bits, the path for the selected gray scale voltages at each decoder passes through a total of 12 transistors (adding non-inverted data and inverted data per each bit of the gray scale data). Thus, as with the present embodiment, the path P1 goes through a total of 24 transistors, and, therefore, the on-resistance of each transistor cannot be ignored.

Thus, as will be described in the following, by configuring the first and second decoders DEC1 and DEC2, it is possible to decrease the number of transistors through which the path, that is formed when the first and second data lines are electrically coupled, passes.

Figure 9:
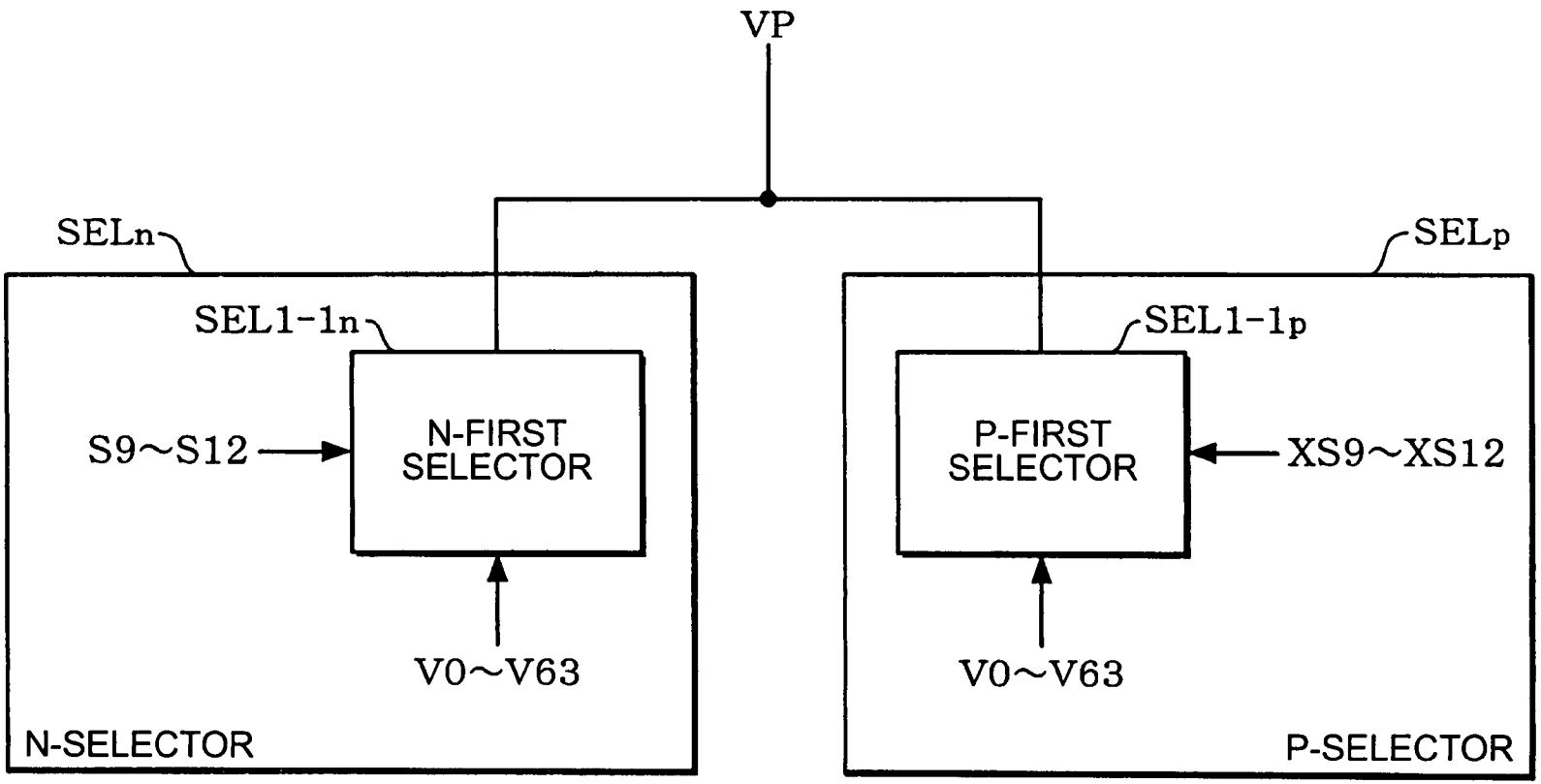
FIG. 9 is a diagram showing a configuration example of a first decoder of the present embodiment.

FIG. 9 shows a configuration example of the first decoder DEC1 of the present embodiment. Although FIG. 9 only shows the configuration of the first decoder DEC1, the same configuration applies to the second decoder DEC2.

The first decoder (to define broadly, the voltage generating circuit) DEC1 electrically couples the inputs of the first and second operational amplifiers with the gray scale voltage signal line (the generated voltage signal line) to which any one of the plurality of gray scale voltages (the generated voltages) selected corresponding to the least significant (b+C) bit data of the gray scale data is supplied based on the most significant a bit data of (a+b+c) (a, b, and c are positive integers) bit gray scale data. Note that, in the following description, it is assumed that "a" is 2, b is 2, and c is 2.

The first decoder DEC1 includes a p-selector SELp and an n-selector SELn. The p-selector SELp is composed of a transmission gate having only a p-metal oxide semiconductor (a p-MOS). The n-selector SELn is composed of a transmission gate having only an n-MOS transistor.

If the p(-type) indicates the first conductivity type, the n(-type) may indicate the second conductivity type; while, if the n(-type) indicates the first conductivity type, the p(-type) may indicate the second conductivity type. The same is true with the following descriptions.

In addition, it can be said that the p-selector SELp and the n-selector SELn are complementary to each other. That is, the voltage drop equivalent in value to the threshold voltage of the n-MOS transistor created at the transmission gate having only the n-MOS transistor is complemented by the output of the transmission gate having only the p-MOS transistor. Likewise, the voltage drop equivalent in value to the threshold voltage of the p-MOS transistor created at the transmission gate having only the p-MOS transistor is complemented by the output of the transmission gate having only the n-MOS transistor.

The p-selector SELp such as this includes a p-first selector SEL1-1p. The n-selector SELn includes an n-first selector SEL1-1n.

With the p-first selector SEL1-1p, a gate signal corresponding to "a" bit data of the gray scale data is applied to a gate of each p-MOS transistor, wherein each p-first selector SEL1-1p includes the plurality of p-MOS transistors whose drains are electrically coupled with one another. FIG. 9 shows a case in which "a" is 2, and gate signals XS9 to SX12 are supplied to each p-MOS transistor gate.

With the n-first selector SEL1-1n, a gate signal corresponding to "a" bit data of the gray scale data is applied to a gate of each n-MOS transistor, wherein each n-first selector SEL1-1n includes the plurality of n-MOS transistors whose drains are electrically coupled with one another. In FIG. 9, gate signals S9 to S12 are supplied to each n-MOS transistor gate.

Then, the node that couples the drains of the p-MOS transistors composing the p-first selector SEL1-1p is electrically coupled with the node that couples the drains of the n-MOS transistors composing the n-first selector SEL1-1n. With the first decoder DEC1, any one of the plurality of gray scale voltages selected corresponding to the (b+C) bit data of the gray scale data is supplied to the source of each of the plurality of MOS transistors composing each of the first and second selectors SEL1-1p and SEL1-1n. As shown in FIG. 9, four gray scale voltages, out of the gray scale voltages V0 to V63, selected corresponding to the least significant 4 bits of the gray scale data are input into each of the first selectors SEL1-1p and SEL1-1n.

With the present embodiment, the gate signals (in FIG. 9, S9 to S12, XS9 to XS12) of each MOS transistor is generated by the predecoder.

With the configuration as described above, the first decoder DEC1 decreases the number of transistors, through which the electric path of the gray scale voltages selected by each of the first selectors SEL1-1p and SEL1-1n passes.

Now, a detailed configuration example of the first decoder DEC1 shown in FIG. 9 will be described.

First is a description of the predecoder.

Figure 10:
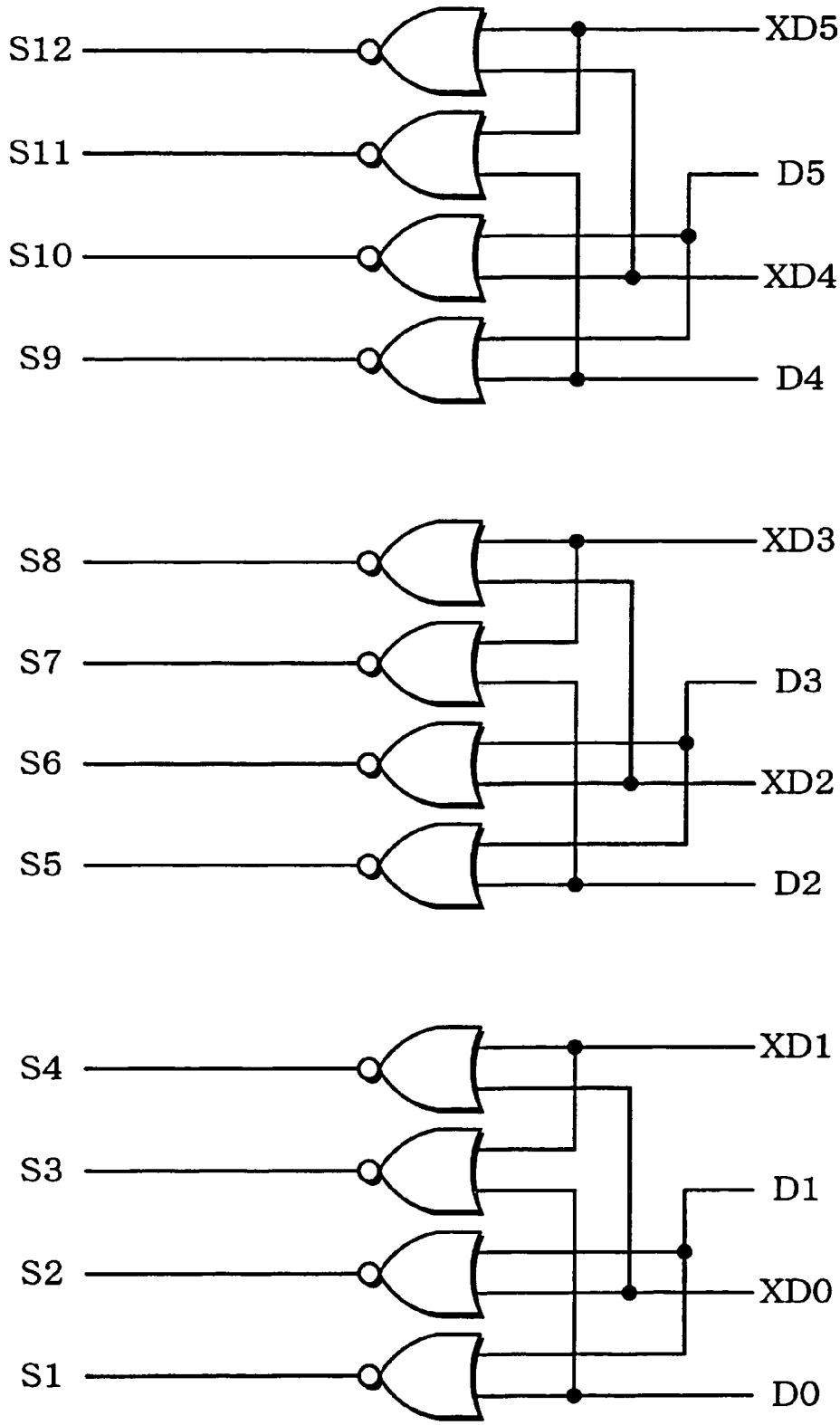
FIG. 10 is a circuit. diagram of a configuration example of a predecoder of the present embodiment.

FIG. 10 shows the configuration example of the predecoder.

This predecoder is provided at each of the first and second decoders DEC1 and DEC2. Of 6 bits of the gray scale data D5 to D0, the most significant bit is D5, and the least significant bit is D0. When 1 bit of the gray scale data is Dx ($0 \leqq x \leqq 5$; x is an integer), XDx is the inverted data of this Dx.

This predecoder generates the gate signals S1 to S12. The gate signals S9 to S12 are generated based on the most significant 2 (a=2) bit data of the gray scale data. More specifically, the gate signals S9 to S12 are generated based on the most significant 2 bit data D5 and D4 and their inverted data XD5 and XD4.

Following the gray scale data D5 and D4, the gray scale data D3 to D0 may indicate the least significant 4 bit data of the gray scale data. With the present embodiment, these least significant 4 bits are further divided into middle 2 bits and least significant 2 bits corresponding to these middle 2 bits.

The gate signals S5 to S8 are generated based on the middle 2 (b=2) bit data of the gray scale data. More specifically, the gate signals S5 to S8 are generated based on the middle 2 bit data D3 and D2 and their inverted data XD3 and XD2.

The gate signals S1 to S4 are generated based on the least significant 2 (c=2) bit data of the gray scale data. More specifically, the gate signals S1 to S4 are generated based on middle 2 bit data D1 and D0 and their inverted data XD1 and XD0.

The gate signals XS1 to XS12 are inverted signals of the gate signals S1 to S12 and may be generated by the predecoder as shown in FIG. 10.

Figure 11:
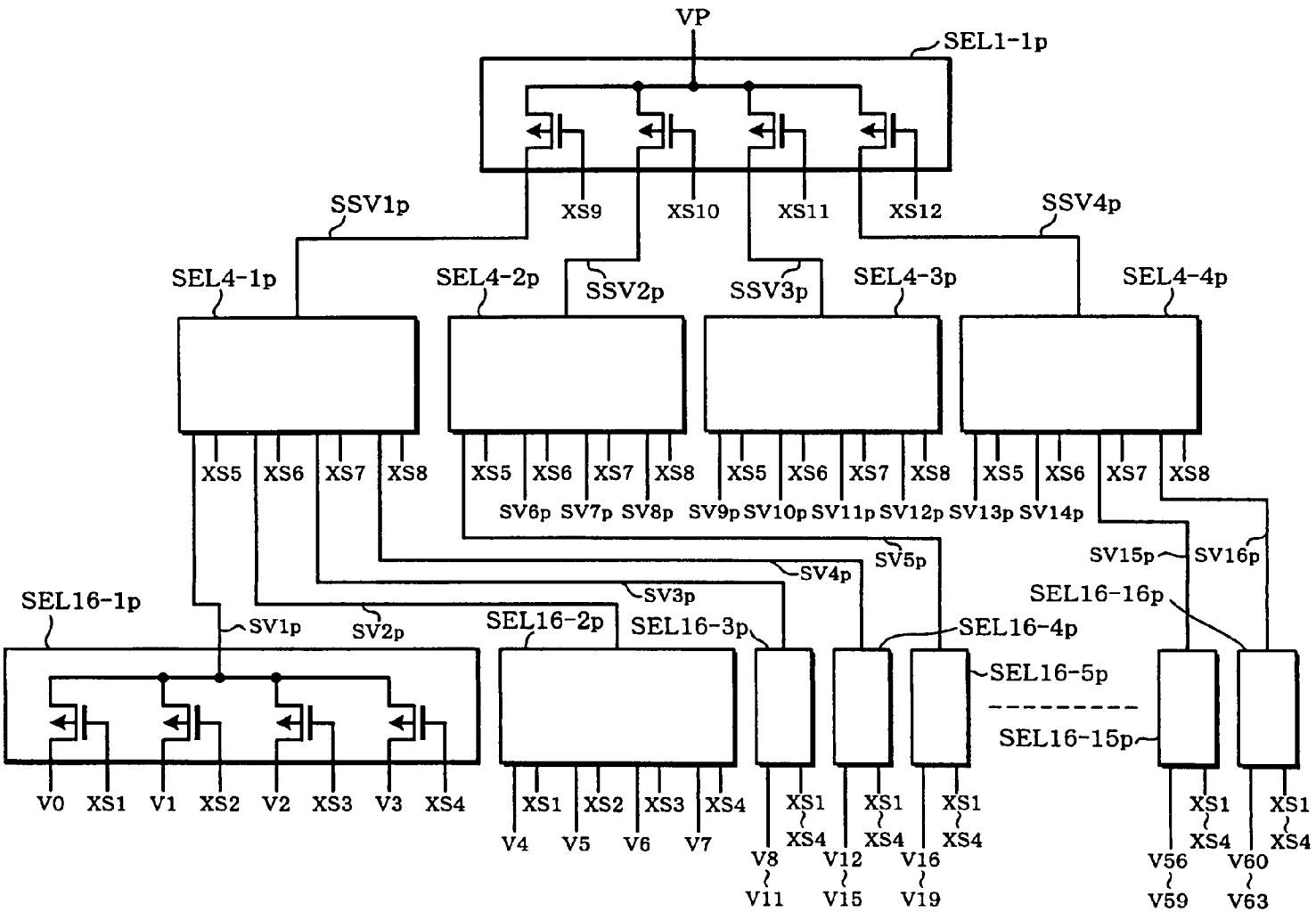
FIG. 11 is a circuit diagram of a configuration example of a p-selector of FIG. 9.

FIG. 11 shows a configuration example of the p-selector SELp.

As shown in FIG. 11, as regards the p-first selector SEL1-1p, any one of the gate signals XS9 to XS12 that corresponds to the most significant 2 (=a) bit data of the gray scale data is applied to the gate of each p-MOS transistor, wherein the p-first selector SEL1-1p includes the plurality of p-MOS transistors, each of whose drains being electrically coupled with one another. The voltage of the node that couples the drains of the p-MOS transistors becomes the voltage to be input to the first operational amplifier OP1 as a gray scale voltage VP.

The p-selector SELp further includes 4 ($=2^2$) p-second selectors SEL4-1p to SEL4-4p. Each of these second selectors has an identical configuration and has the same configuration as that of the p-first selector SEL1-1p.

As regards each of the p-second selectors SEL4-1p to SEL4-4p, any one of the gate signals XS5 to XS8 that corresponds to the middle 2 (=b) bit data of the gray scale data is applied to the gate of each p-MOS transistor, wherein each of these p-second selectors includes a plurality of p-MOS transistors whose drains are electrically coupled with one another. Further, the node, at which the drains are electrically coupled with one another, is electrically coupled with any one of the sources of the p-MOS transistors composing the p-first selector SEL1-1p.

The p-selector SELp includes additional 16 ($=2^{2+2}$) p-third selectors SEL16-1p-SEL16-16p. Each third selector has an identical configuration and has the same configuration as that of the p-first selector SEL1-1p.

As regards each of the p-third selectors SEL16-1p to SEL16-16p, any one of the gate signals XS1 to XS4 that corresponds to the least significant 2 (=c) bit data of the gray scale data is applied to the gate of each p-MOS transistor, wherein each of these p-third selectors includes a plurality of p-MOS transistors whose drains are electrically coupled with one another. Further, the node, at which the drains are electrically coupled with one another, is electrically coupled with any one of the sources of the p-MOS transistors composing the p-second selectors SEL4-1p to SEL 4-4p.

More precisely, the node of the p-third selectors SEL16-1p to SEL16-4p is electrically coupled with any one of the sources of the p-MOS transistors composing the p-second selector SEL4-1p. The node of the p-third selectors SEL16-5p to SEL16-8p is electrically coupled with any one of the sources of the p-MOS transistors composing the p-second selector SEL4-2p. The node of the p-third selectors SEL16-9p to SEL16-12p is electrically coupled with any one of the sources of the p-MOS transistors composing the p-second selector SEL4-3p. The node of the p-third selectors SEL16-13p to SEL16-16p is electrically coupled with any one of the sources of the p-MOS transistors composing the p-second selector SEL4-4p.

Further, each of the gray scale voltages V0 to V3 is supplied to the source of each of the p-MOS transistors composing the p-third selector SEL16-1p. Each of the gray scale voltages V4 to V7 is supplied to the source of each of the p-MOS transistors composing the p-third selector SEL16-2p. Similarly, each of other gray scale voltages as shown in FIG. 11 is supplied to the source of each of the p-MOS transistors composing the other p-third selectors.

Figure 12:
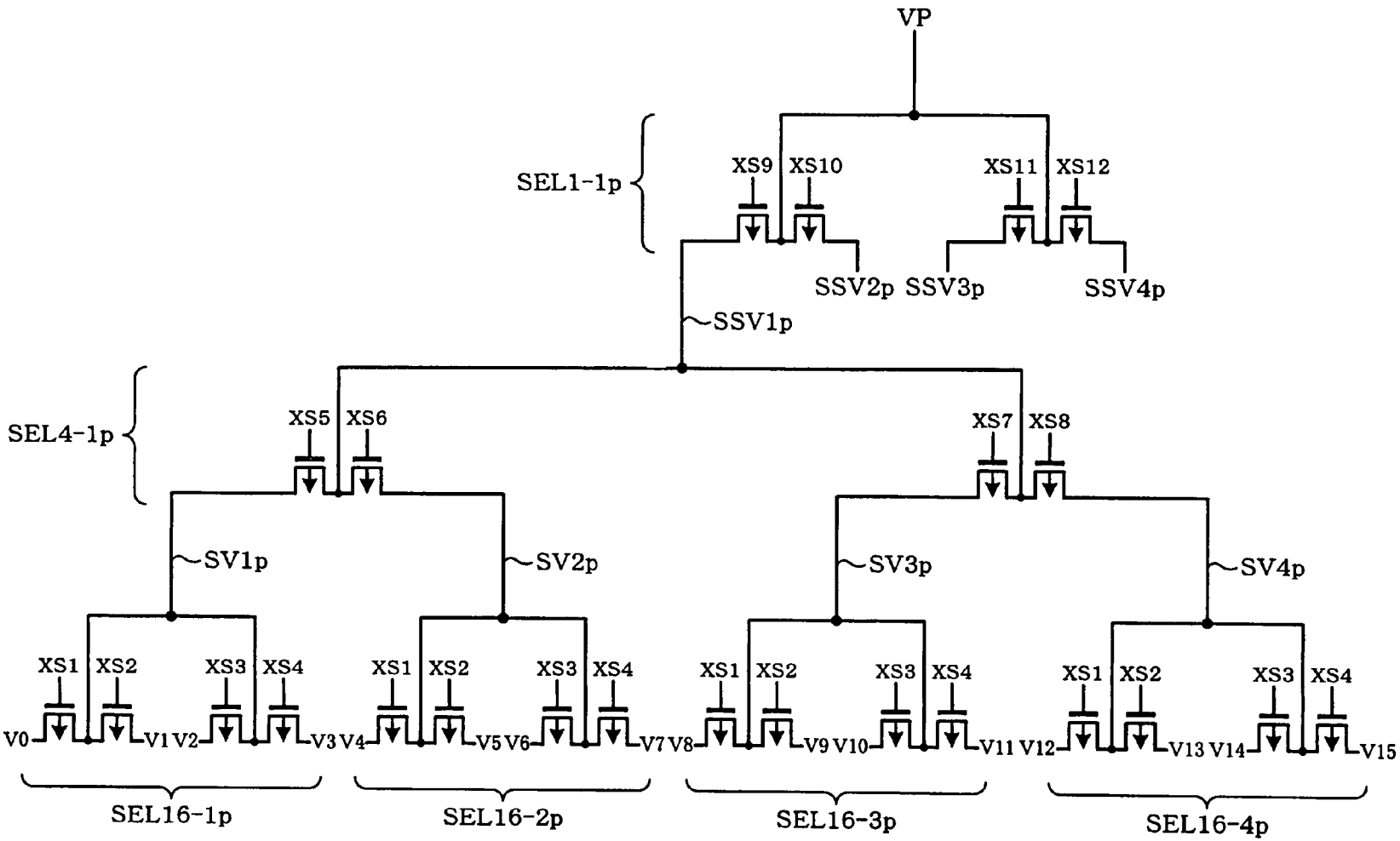
FIG. 12 is a diagram illustrating a part of an example of a path formed in the p-selector of FIG. 11.

FIG. 12 shows a part of an example of the path P1 formed in the p-selector SELp of FIG. 11.

As described above, each gray scale voltage is generated at each resistance division node of the reference voltage generating circuit 527. In addition, the path for inputting from the resistance division node to the first operational amplifier OP1 is determined by the gate signal generated based on the gray scale data.

For example, if the gray scale voltage V3 is selected, the path goes through the p-transistors having the gate signals XS4, XS4, and XS9, and, therefore, the number of transistors through which the path passes in the p-selector SELp will be three.

Figure 13:
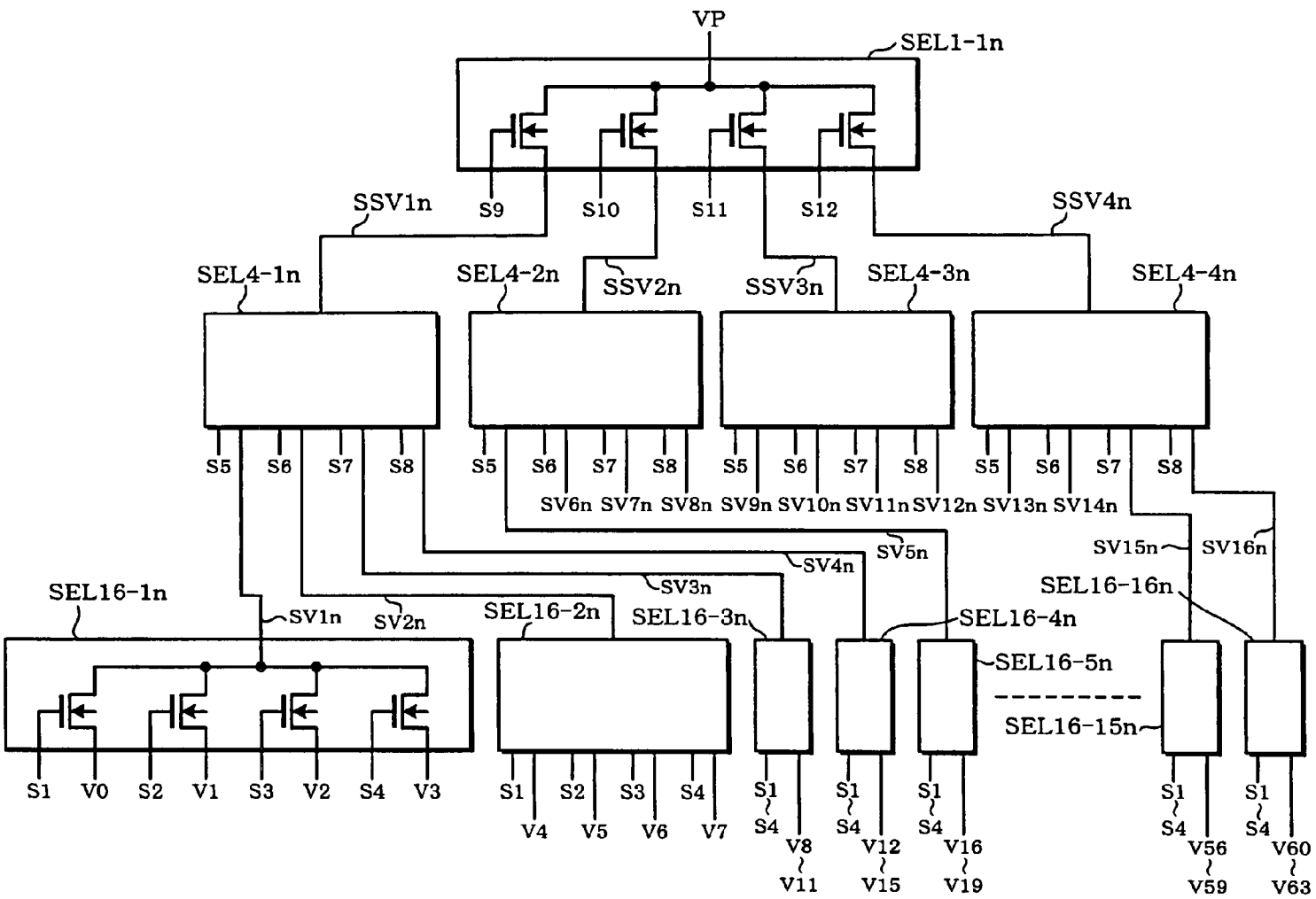
FIG. 13 is a circuit diagram of a configuration example of an n-selector of FIG. 9.

FIG. 13 shows a configuration example of the n-selector SELn.

As shown in FIG. 13, as regards the n-first selector SEL1-1n, any one of the gate signals S9 to S12 that corresponds to the most significant 2 (=a) bit data of the gray scale data is applied to the gate of each p-MOS transistor, wherein the n-first selector SEL1-1n includes a plurality of n-MOS transistors whose drains are electrically coupled with one another. The voltage of the node that couples the drains of the n-MOS transistors becomes the voltage to be input to the first operational amplifier OP1 as a gray scale voltage VP.

The n-selector SELn further includes 4 ($=2^2$) n-second selectors SEL4-1n to SEL4-4n. Each second selector has an identical configuration and has the same configuration as that of the n-first selector SEL1-1n.

As regards each of the n-second selectors SEL4-1n to SEL4-4n, any one of the gate signals S5 to S8 that corresponds to the 2 (=b) bit data of the gray scale data is applied to the gate of each n-MOS transistor, wherein each of these n-second selectors includes a plurality of n-MOS transistors whose drains are electrically coupled with one another. Further, the node, at which the drains are electrically coupled with one another, is electrically coupled with any one of the sources of the n-MOS transistors composing the n-first selector SEL1-1n.

The n-selector SELn further includes 16 ($=2^{2+2}$) n-third selectors SEL16-1n to SEL16-16n. Each third selector has an identical configuration and has the same configuration as that of the n-first selector SEL1-1n.

As regards each of the n-third selectors SEL16-1n to SEL16-16n, any one of the gate signals S1 to S4 that corresponds to the least significant 2 (=c) bit data of the gray scale data is applied to the gate of each n-MOS transistor, wherein each of these n-third selectors includes a plurality of n-MOS transistors whose drains are electrically coupled with one another. Further, the node, at which the drains are electrically coupled with one another, is electrically coupled with any one of the sources of the n-MOS transistors composing the n-second selectors SEL4-1n to SEL 4-4n.

More precisely, the node of the n-third selectors SEL16-1n to SEL16-4n is electrically coupled with any one of the sources of the n-MOS transistors composing the n-second selector SEL4-1n. The node of the n-third selectors SEL16-5n to SEL16-8n is electrically coupled with any one of the sources of the n-MOS transistors composing the n-second selector SEL4-2n. The node of the n-third selectors SEL16-9n to SEL16-12n is electrically coupled with any one of the sources of the n-MOS transistors composing the n-second selector SEL4-3n. The node of the n-third selectors SEL16-13n to SEL16-16n is electrically coupled with any one of the sources of the n-MOS transistors composing the n-second selector SEL4-4n.

Further, each of the gray scale voltages V0 to V3 is supplied to the source of each of the n-MOS transistors composing the n-third selector SEL16-1n. Each of the gray scale voltages V4 to V7 is supplied to the source of each of the n-MOS transistors composing the n-third selector SEL16-2n. Similarly, each of other gray scale voltages as shown in FIG. 13 is supplied to the source of each of the n-MOS transistors composing the other n-third selectors.

Figure 14:
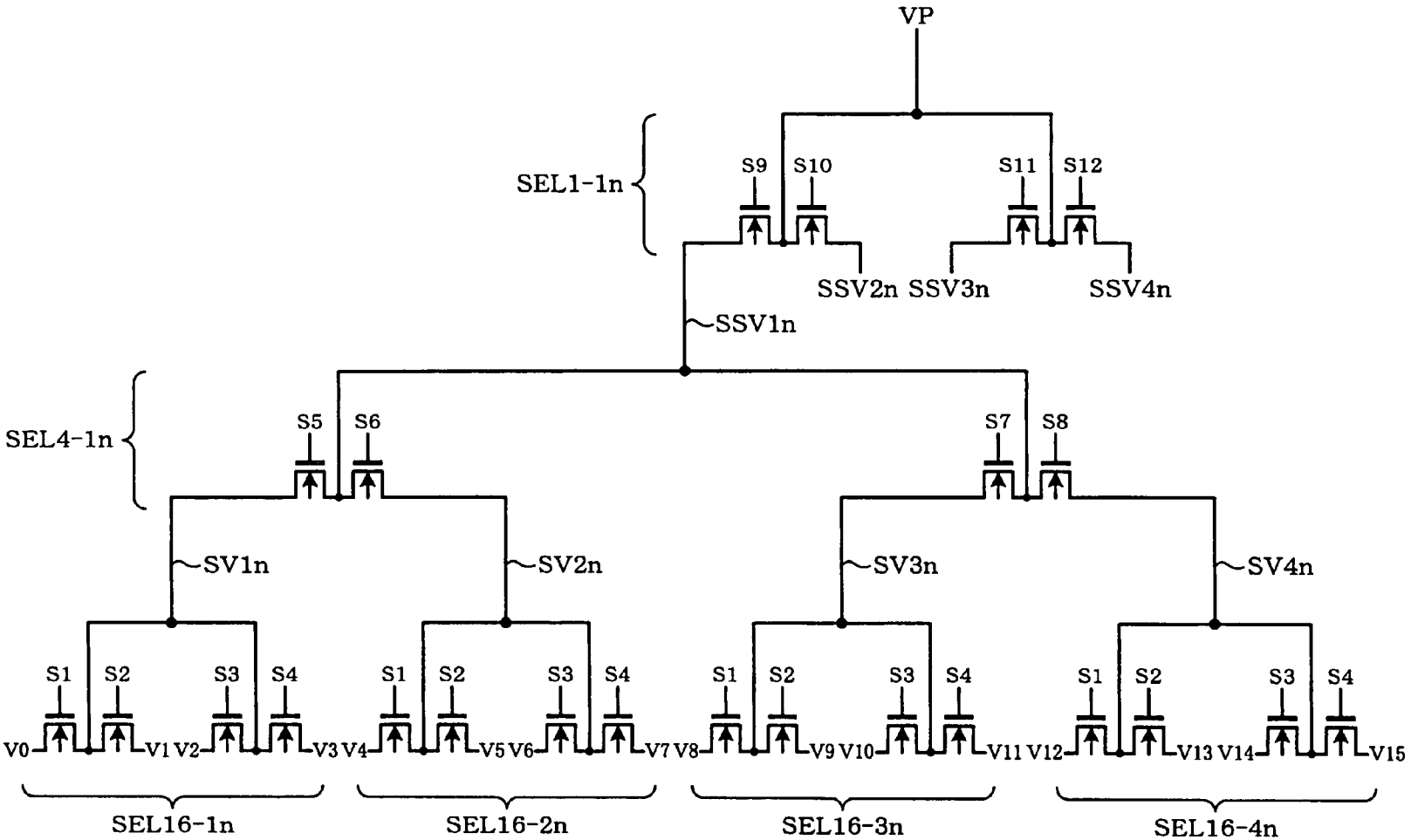
FIG. 14 is a diagram illustrating a part of an example of a path formed in the n-selector of FIG. 13.

FIG. 14 shows a part of an example of the path P1 formed in the n-selector SELn of FIG. 13.

As described referring to IG. 12, if the gray scale voltage V3 is selected, for example, the path goes through the n-transistors having the gate signals S4, S5, and S9, and, therefore, the number of transistors through which the path passes in the n-selector SELn will be three.

Figure 15:
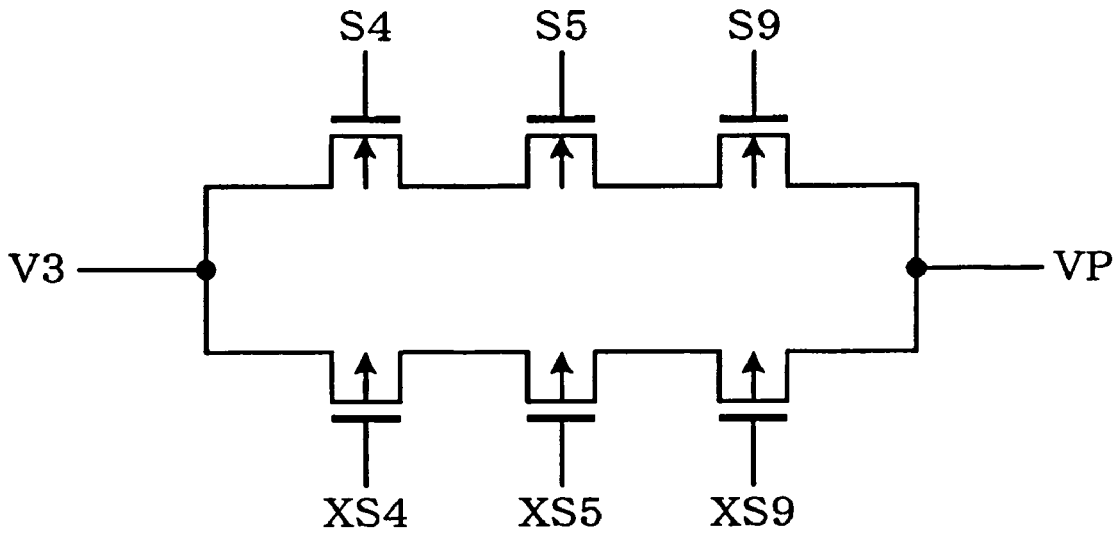
FIG. 15 is a diagram illustrating a gray scale-voltage input path formed in the first decoder of the present embodiment.

FIG. 15 is a diagram illustrating the path P1 in the first decoder DEC1. FIG. 15 illustrates the path when the gray scale voltage V3 is selected as shown in FIGS. 12 and 14.

With the present embodiment, the gate signals S1 to S12 generated at the predecoder shown in FIG. 10 are applied to the n-MOS transistors of the n-selector SELn, while the gate signals XS1 to XS12 obtained by inverting the gate signals S1 to S12 are applied to the p-MOS transistors of the p-selector SELp. Therefore, if the gray scale voltage V3 is selected at the n-selector SELn, the gray scale voltage V3 is also selected at the p-selector SELp. Thus, the path as shown in FIG. 15 is formed.

By configuring the above-described first decoder DEC1 as the voltage generating circuit by corresponding to each data line, the path P1 as shown in FIG. 7 needs to pass only six transistors. Therefore, contrary to what was described in FIG. 8(A) and FIG. 8(B), the impedance that is dependent on the on-resistance of the transistor can be reduced by one fourth, and thereby the voltage drop inside the first and second decoders DEC1 and DEC2 can be prevented.

Further, by configuring the circuit of each of the first and second decoders DEC1 and DEC2 in a manner as described above, a layout arrangement as will be described below becomes possible, and various effects can be exerted.

Figure 16:
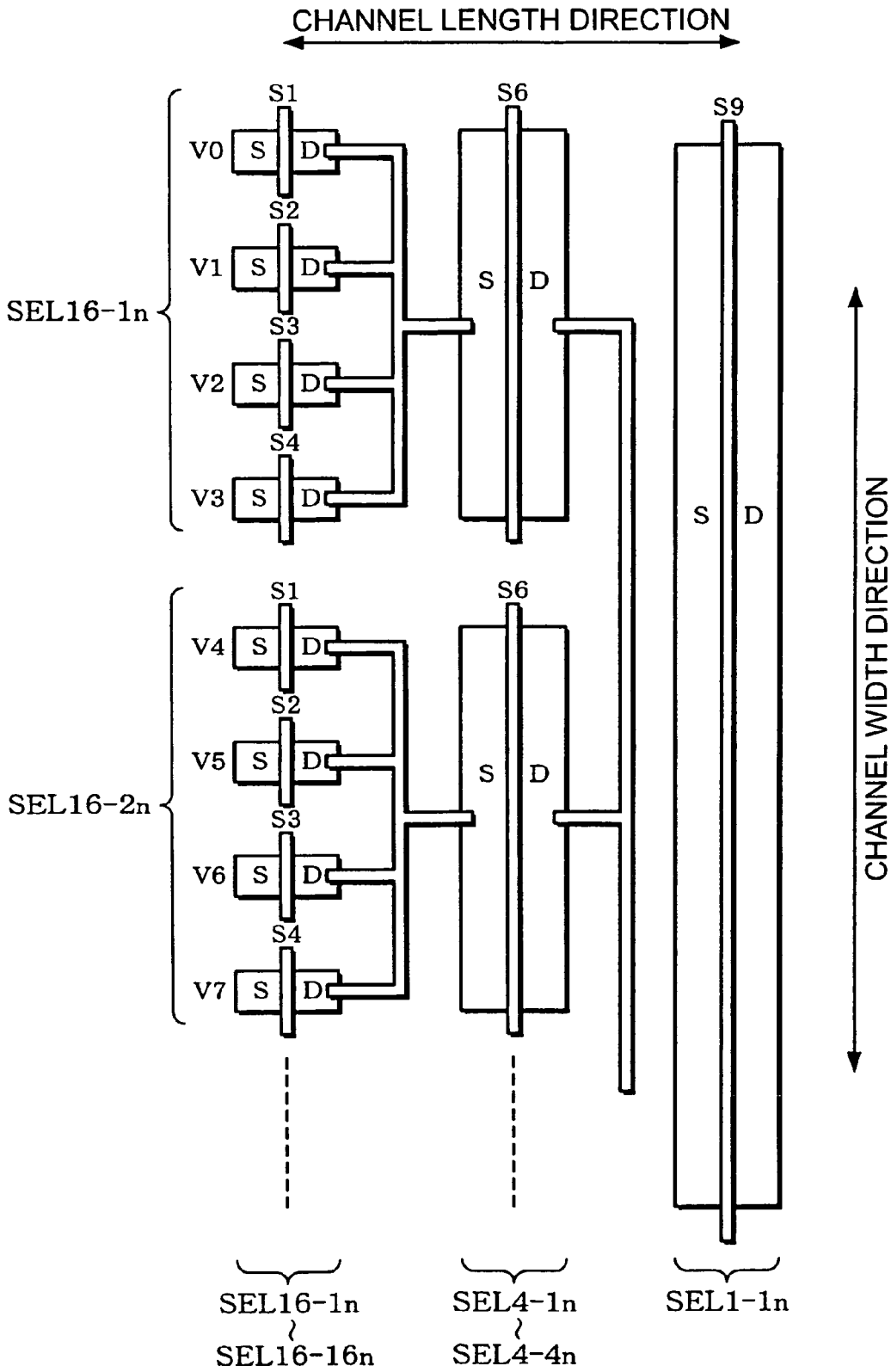
FIG. 16 is a model plan view of a layout arrangement of the n-selector.

FIG. 16 shows a model plan view of a layout arrangement of the n-selector SELn.

Note that FIG. 16 only illustrates a source region S, a drain region D, a gate electrode, and a wire layer for electrically coupling the MOS transistors, and the rest is omitted from the drawing. As an example, a gate signal S1 is supplied to the gate electrode of the MOS transistor composing the third selector, and the drain electrode of the transistor, to whose source region the gray scale voltage V0 is applied, is electrically coupled with the source region of the MOS transistor of the second selector, to whose gate electrode the gate signal S5 is supplied.

With the n-selector SELn, the number of the first selectors is smaller than the number of the second selectors. If the channel width direction is the direction shown in FIG. 16, the channel length direction can be the direction that intersects with the channel width direction. Further, each of the n-MOS transistors composing the $2^2$ ($=2^a$) n-second selectors SEL4-1n to SEL 4-4n is arranged in the direction intersecting with the channel width direction. Here, the channel width directions of the MOS transistors composing the n-first and n-second selectors SEL1-1n and SEL4-1n to SEL4-4n are made to be parallel with each other.

Consequently, the on-resistance of each of the MOS transistors composing the n-first selector SEL1-1n can be made smaller than the on-resistance of each of the MOS transistors composing the n-second selectors SEL4-1n to SEL4-4n. This is because, since the number of the first selectors is smaller than the number of the second selectors as described above, the channel width of the MOS transistor composing the first selector can be made larger than the channel width of the MOS transistor composing the second selector without unnecessarily broadening the layout arrangement region.

As shown in FIGS. 13 and 14, the path for the selected gray scale voltages always goes through the MOS transistors composing the first selector. Therefore, by lowering the on-resistance of the MOS transistors composing the first selector, the voltage drop can be effectively prevented.

Now, in FIG. 16, the layout region for the first and second selectors is described; however, the layout region for the second and the third selectors can also be obtained in the same manner, and the same effect can be exerted. That is to say, by lowering the on-resistance of the MOS transistors composing the second selector, the voltage drop can be prevented more effectively compared with when lowering the on-resistance of the MOS transistors composing the third selector.

Further, although FIG. 16 only shows the model plan view of the layout arrangement of the n-selector SELn, the same layout arrangement can be made with the p-selector SELp.

Figure 17A:
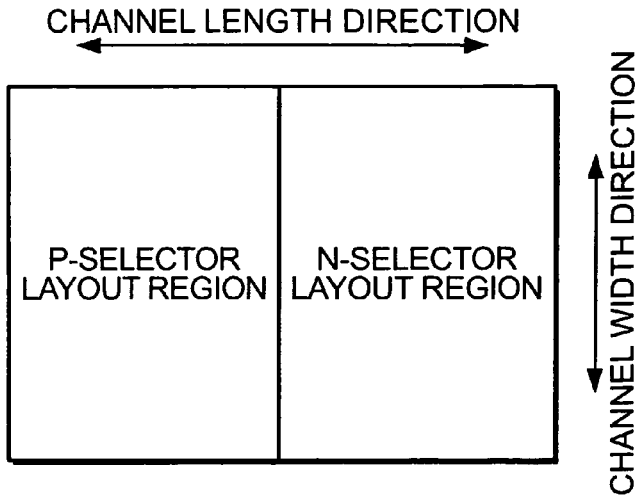
FIG.17(A) and FIG.17(B) are diagrams showing an example of layout arrangements of the n-selector and p-selector.
Figure 17B:
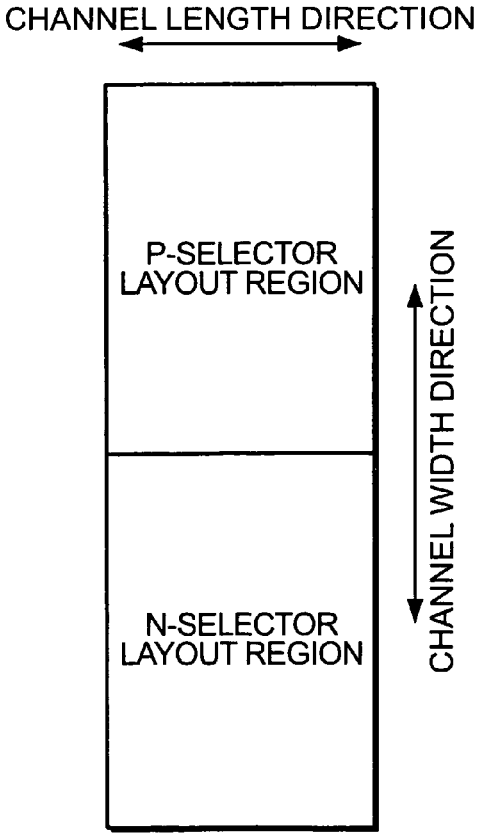

FIG. 17(A) and FIG. 17(B) show examples of layout arrangements of the n-selector and p-selector.

In FIG. 17(A), the p-selector SELp and n-selector SELn are arranged so that they lie next to each other in the channel length direction. For example, the arrangement that the first operational amplifier OP1 is in the channel width direction as shown in FIG. 17(A) can be employed if there is enough distance between the output electrodes to which the outputs of each of the operational amplifiers are coupled.

In FIG. 17(B), the p-selector SELp and n-selector SELn are arranged so that they lie next to each other in the channel width direction. For example, the arrangement that the first operational amplifier OP1 is in the channel width direction as shown in FIG. 17(B) can be valid if there is not enough distance between the output electrodes to which the outputs of each of the operational amplifiers are coupled.

Additionally, the present invention is not limited to the above-described embodiment but may have various alternative embodiments within the gist of the claims of the present invention. For example, the present invention can be applied not only for driving the aforementioned liquid-crystal panel but also for driving an electroluminescence and plasma display devices.

With the embodiment as herein described, the gray scale data is explained as being 6 bits; however, it is not limited thereto. The same is true with the gray scale data that is explained as being 2 to 5 or more than 7 bits.

Further, the present embodiment describes the situation in which the above-described voltage generating circuit is applied to the DAC of the data driver; however other situations are possible. The above-described voltage generating circuit can be applied to anything that selects generated voltages corresponding to digital data from a plurality of generated voltages.

Moreover, the inventions of the dependent claims of the present invention may omit some of the aspects of the claims that these dependent claims depend on. Further, the essential elements of the invention of the independent Claim(s) of the present invention may depend on other independent claims.

What is claimed is:

1. A data driver that drives a plurality of data lines of an electro-optical device including a plurality of scan lines and the plurality of data lines based on gray scale data, comprising:

a gamma correction resistor that divides a voltage with resistance between a first power source voltage and a second power source voltage in order to generate a divided voltage and outputs the divided voltage to a resistance division node as a gray scale voltage;

a gray scale voltage signal line to which the gray scale voltage is supplied;

a gray scale voltage supply switch provided between the resistance division node and the gray scale voltage signal line;

a first operational amplifier that drives a first data line of the plurality of data lines and that comprises a first input that electrically coupled with the gray scale voltage signal line;

a second operational amplifier that drives a second data line of the plurality of data lines and that comprises a second input that is electrically coupled with the gray scale voltage signal line;

a first bypass switch provided between the input and an output of the first operational amplifier by bypassing the first operational amplifier; and a second bypass switch provided between the input of the second operational amplifier and an output of the second operational amplifier by bypassing the second operational amplifier, wherein:

the gray scale voltage supply switch is set to a conductive state and the first and second bypass switches are set to a cut-off state to drive the first data line by the first operational amplifier and to drive the second data line by the second operational amplifier based on the gray scale voltage during a first period of a drive period; and the gray scale voltage supply switch is set to a cut-off state, the first and second bypass switches are set to a conductive state, and outputs of the first and second operational amplifiers are set to a high-impedance state, so as to electrically couple the first data line and the second data line via the gray scale voltage signal line, the first bypass switch and the second bypass switch during a second period succeeding the first period of the drive period.

2. The data driver according to claim 1, further comprising a gamma correction resistance switch of which one end receives the first and second power source voltages, and the other end is coupled to the gamma correction resistor, wherein the gamma correction resistance switch is set to a conductive state during the first period, and the gamma correction resistance switch is set to a cut-off state during the second period.

3. The data driver according to claim 1, wherein, during the second period, an operation current of the first and second operational amplifiers is either stopped or limited.

4. The data driver according to claim 1, further comprising:

a plurality of gray scale voltage supply switches, each gray scale voltage supply switch being provided between each of a plurality of resistance division nodes of the gamma correction resistor and each of a plurality of gray scale voltage signal lines;

a first decoder for electrically coupling any one of the plurality of gray scale voltage signal lines with the input of the first operational amplifier based on first gray scale data corresponding to the first data line; and a second decoder for electrically coupling any one of the plurality of gray scale voltage signal lines with the input of the second operational amplifier based on second gray scale data corresponding to the second data line, wherein:

each of the first and second decoders electrically couples the inputs of the first and second operational amplifiers with the gray scale voltage signal line, any one of a plurality of gray scale voltages selected corresponding to least significant (b+c) bit data of the gray scale data based on most significant a bit data of (a+b+c) (a, b, and c are positive integers) bit gray scale data being supplied to the gray scale voltage signal line; and when the first and second gray scale data are identical, the first and second data lines are electrically coupled via the gray scale voltage signal line, the first bypass switch, and the second bypass switch.

5. The data driver according to claim 4, wherein each of the first and second decoders comprises:

a first selector of a first conductivity type having a plurality of MOS transistors of the first conductivity type whose drains are electrically coupled with one another, a gate signal corresponding to the a bit data of the gray scale data being applied to a gate of each MOS transistor of the first conductivity type; and a first selector of a second conductivity type having a plurality of MOS transistors of the second conductivity type whose drains are electrically coupled with one another, a gate signal corresponding to the a bit data of the gray scale data being applied to a gate of each MOS transistor of the second conductivity type, wherein:

a node for coupling drains of MOS transistors of the first conductivity type composing the first selector of the first conductivity type is electrically coupled with a node for coupling drains of MOS transistors of the second conductivity type composing the first selector of the second conductivity type; and any one of the plurality of gray scale voltages selected corresponding to the (b+c) bit data of the gray scale data is supplied to a source of each of the plurality of MOS transistors composing each first selector.

6. The data driver according to claim 5, further comprising:

$2^a$ second selectors of the first conductivity type; and $2^a$ a second selectors of the second conductivity type, wherein:

the second selector of the first conductivity type contains a plurality of MOS transistors of the first conductivity type whose drains are electrically coupled with one another, a gate signal corresponding to the b bit data of the gray scale data being applied to a gate of each MOS transistor of the first conductivity type;

a node at which the drains of the MOS transistors of the first conductivity type are electrically coupled with one another is electrically coupled with any one of sources of the MOS transistors of the first conductivity type composing the first selector of the first conductivity type;

the second selector of the second conductivity type contains a plurality of MOS transistors of the second conductivity type whose drains are electrically coupled with one another, a gate signal corresponding to the b bit data of gray scale data being applied to a gate of each MOS transistor of the second conductivity type; and a node at which the drains of the MOS transistors of the second conductivity type are electrically coupled with one another is electrically coupled with any one of sources of the MOS transistors of the second conductivity type composing the first selector of the second conductivity type.

7. The data driver according to claim 6, wherein:

each MOS transistor composing the $2^a$ second selectors of the first conductivity type is arranged in a direction intersecting with a channel width direction of each MOS transistor composing the first selector of the first conductivity type;

the channel width directions of the MOS transistors composing the first and second selectors of the first conductivity type are parallel with each other; and an on-resistance of each MOS transistor composing the first selector of the first conductivity type is smaller than an on-resistance of each MOS transistor composing the second selector of the first conductivity type.

8. The data driver according to claim 7, wherein the channel width of each MOS transistor composing the first selector of the first conductivity type is larger than the channel width of each MOS transistor composing the second selector of the first conductivity type.

9. A display device comprising:

a plurality of scan lines;

a plurality of data lines;

a plurality of switching elements, each of which being electrically coupled with each scan line and each data line;

a scan driver for driving the plurality of scan lines; and the data driver according to claim 1 for driving the plurality of data lines.

10. A method for controlling a data driver for driving a plurality of data lines based on gray scale data, the data driver including:

a gamma correction resistor for dividing a voltage with resistance between a first power source voltage and a second power source voltage and outputting the divided voltage to a resistance division node as a gray scale voltage;

a gray scale voltage signal line to which the gray scale voltage is supplied;

a gray scale voltage supply switch provided between the resistance division node and the gray scale voltage signal line;

a first operational amplifier and a second operational amplifier for driving a first data line and a second data line out of the plurality of data lines of an electro-optical device, inputs of the first and second operational amplifiers being electrically coupled with the gray scale voltage signal line; and a first bypass switch and a second bypass switch provided between the input and an output of the first and second operational amplifiers by bypassing each of the first and second operational amplifiers, the method comprising the steps of:

setting the gray scale voltage supply switch to a conductive state and the first and second bypass switches to a cut-off state, so as to drive the first and second data lines based on the gray scale voltage by the first and second operational amplifiers during a first period of a drive period; and setting the gray scale voltage supply switch to a cut-off state, the first and second bypass switches to a conductive state, and the outputs of the first and second operational amplifiers to a high-impedance state, so as to electrically couple the first data line with the second data line via the gray scale voltage signal line, the first bypass switch and the second bypass switch during a second period succeeding the first period of the drive period.

11. The method for controlling a data driver according to claim 10, further comprising electrically cutting the coupling between the gamma correction resistor and the first or second power source voltage during the second period.

12. The method for controlling a data driver according to claim 10, further comprising stopping or limiting an operation current of the first and second operational amplifiers during the second period.

13. A data driver that drives a plurality of data lines of an electro-optical device including a plurality of scan lines and the plurality of data lines based on gray scale data, comprising:

a gamma correction resistor that divides a voltage with resistance between a first power source voltage and a second power source voltage in order to generate a divided voltage and outputs the divided voltage to a resistance division node as a gray scale voltage;

a gray scale voltage signal line to which the gray scale voltage is supplied;

a gray scale voltage supply switch provided between the resistance division node and the gray scale voltage signal line;

a first operational amplifier that drives a first data line of the plurality of data lines and that comprises a first input that is electrically coupled with the gray scale voltage signal line;

a second operational amplifier that drives a second data line of the plurality of data lines and that comprises a second input that is electrically coupled with the gray scale voltage signal line;

a first bypass switch provided between the input and an output of the first operational amplifier by bypassing the first operational amplifier; and a second bypass switch provided between the input of the second operational amplifier and an output of the second operational amplifier by bypassing the second operational amplifier, wherein:

the gray scale voltage supply switch is set to a conductive state and the first and second bypass switches are set to a cut-off state to drive the first data line by the first operational amplifier and to drive the second data line by the second operational amplifier based on the gray scale voltage during a first period of a drive period; and the gray scale voltage supply switch is set to a cut-off state, the first and second bypass switches are set to a conductive state, and outputs of the first and second operational amplifiers are set to a high-impedance state, so as to electrically couple the first data line and the second data line via the gray scale voltage signal line, the first bypass switch and the second bypass switch during a second period after the first period of the drive period.

14. The data driver according to claim 13, wherein the drive period is a horizontal period specified by a horizontal synchronization signal.

* * * * *